US008235546B2

(12) United States Patent
Takasago et al.

(10) Patent No.: US 8,235,546 B2
(45) Date of Patent: Aug. 7, 2012

(54) LIGHT SOURCE MODULE HAVING A PLURALITY OF LIGHT-EMITTING ELEMENTS AND ILLUMINATION APPARATUS

(75) Inventors: Masako Takasago, Yokohama (JP); Masahiro Toda, Yokosuka (JP); Hirokazu Yamada, Yokohama (JP); Kenji Nezu, Yokosuka (JP); Keisuke Ono, Chigasaki (JP)

(73) Assignee: Toshiba Lighting & Technology Corporation, Tokyo (JP)

( * ) Notice: Subject to any disclaimer, the term of this patent is extended or adjusted under 35 U.S.C. 154(b) by 316 days.

(21) Appl. No.: 12/473,482

(22) Filed: May 28, 2009

(65) Prior Publication Data

US 2009/0303715 A1 Dec. 10, 2009

(30) Foreign Application Priority Data

Jun. 9, 2008 (JP) ..... 2008-151098

(51) Int. Cl.
*F21V 1/00* (2006.01)

(52) U.S. Cl. ..... 362/235; 362/249.01; 362/249.02; 362/227; 362/241

(58) Field of Classification Search ..... 362/249.01, 362/249.02, 431, 227, 235, 237, 240, 241, 362/247, 249.05, 249.06
See application file for complete search history.

(56) References Cited

U.S. PATENT DOCUMENTS

| | | | | |
|---|---|---|---|---|
| 7,414,546 | B2 * | 8/2008 | Singer et al. | 340/961 |
| 7,434,959 | B1 | 10/2008 | Wang | |
| 7,506,997 | B1 * | 3/2009 | Eriksson | 362/241 |
| 2003/0117798 | A1 * | 6/2003 | Leysath | 362/248 |
| 2003/0156416 | A1 | 8/2003 | Stopa | |
| 2005/0030752 | A1 * | 2/2005 | Imai | 362/267 |
| 2007/0121343 | A1 | 5/2007 | Brown | |
| 2007/0247856 | A1 | 10/2007 | Wang | |
| 2008/0062689 | A1 | 3/2008 | Villard | |
| 2008/0123367 | A1 * | 5/2008 | Pan et al. | 362/628 |
| 2008/0186695 | A1 * | 8/2008 | Awai et al. | 362/92 |
| 2010/0142201 | A1 * | 6/2010 | Venturini | 362/235 |
| 2010/0214780 | A1 | 8/2010 | Villard | |
| 2010/0296289 | A1 | 11/2010 | Villard | |

FOREIGN PATENT DOCUMENTS

| | | | |
|---|---|---|---|
| CN | 2842187 | Y | 11/2006 |
| CN | 101101096 | A | 1/2008 |
| CN | 101101102 | A | 1/2008 |
| DE | 20200700114 | | 3/2007 |
| GB | 487122 | | 6/1938 |
| JP | 2003-203506 | | 7/2003 |

(Continued)

OTHER PUBLICATIONS

European Search Report issued in EP 09014067.4 dated Mar. 16, 2010.

(Continued)

*Primary Examiner* — Evan Dzierzynski
(74) *Attorney, Agent, or Firm* — DLA Piper LLP US

(57) ABSTRACT

A light source module has a reflector having a light reflection face and a plurality of light emitting elements. The light reflection face is curved in a circular arc shape in a width direction of the reflector and extends in a longitudinal direction of the reflector. The light emitting elements are arranged in a center portion in the width direction of the light reflection face and are arranged linearly along the longitudinal direction of the reflector.

17 Claims, 18 Drawing Sheets

FOREIGN PATENT DOCUMENTS

| | | |
|---|---|---|
| JP | 2004-200102 | 7/2004 |
| JP | 3694310 | 6/2006 |
| JP | 2007-165051 | 6/2007 |
| JP | 2007-242258 | 9/2007 |
| JP | 3137249 | 10/2007 |
| JP | 2009-290244 | 12/2009 |
| WO | WO 2007/088665 | 8/2007 |

OTHER PUBLICATIONS

English abstract of JP-2004-200102.
Machine English language translation of JP-2004-200102.
English Language Abstract of JP 2007-242258 published Sep. 20, 2007.
English Language Translation of JP 2007-242258 published Sep. 20, 2007.
Office Action issued in corresponding application CN 200910146456.8 on Jun. 23, 2010.
English Translation of Office Action issued in corresponding application CN 200910146456.8 on Jun. 23, 2010.
English Language Abstract of CN 101101096A, published Jan. 9, 2008.
English Language Abstract of CN 2842187Y, published Nov. 29, 2006.
English Language Abstract of CN 101101102A, published Jan. 9, 2008.
English Language Abstract of JP 2009-290244 published Dec. 10, 2009.
English Language Translation of JP 2009-290244 published Dec. 10, 2009.
English Language Abstract of JP 2003-203506 published Jul. 18, 2003.
English Language Translation of JP 2003-203506 published Jul. 18, 2003.
English Language Abstract of JP 2007-165051 Published Jun. 28, 2007.
English Language Translation of JP 2007-165051 Published Jun. 28, 2007.
English Language Abstract of JP 2006-156192 Published Jun. 15, 2006.
English Language Translation of JP 2006-156192 Published Jun. 15, 2006.
English Language Abstract of JP 3137249 Published Oct. 24, 2007.
English Language Translation of JP 3137249 Published Oct. 24, 2007.
European Search Report issued in EP 09007244 on Sep. 22, 2011.
Office Action mailed Apr. 18, 2012 issued in related U.S. Appl. No. 12/615,753.

* cited by examiner

LIGHT SOURCE MODULE HAVING A PLURALITY OF LIGHT-EMITTING ELEMENTS AND ILLUMINATION APPARATUS

CROSS-REFERENCE TO RELATED APPLICATIONS

This application is based upon and claims the benefit of priority from prior Japanese Patent Application No. 2008-151098, filed Jun. 9, 2008, the entire contents of which are incorporated herein by reference.

BACKGROUND OF THE INVENTION

1. Field of the Invention

The present invention relates to an illumination apparatus which is assumed to be used mainly outdoors, such as a street light, a garden light, or a projector. Further, the invention relates to a light source module using, for example, a plurality of light emitting diodes as a light source.

2. Description of the Related Art

An illumination apparatus for outdoors, such as a street light which illuminates a sidewalk and a roadway, is attached to a high point of a pole mounted at the side of a road. The illumination apparatus for outdoors of this kind uses, for example, a fluorescent lamp or an HID lamp as a light source. In recent years, to realize energy saving and easier maintenance, an attempt is being made to use a light emitting diode as the light source for outdoor illumination apparatuses in place of a fluorescent lamp or an HID lamp.

As regards a street light for increasing a crime prevention effect, for example, appropriate illumination intensity according to location is suggested so that the shape, the face shape, and the like of a person can be identified. Specifically, it is recommended to set a street light whose horizontal illuminance (average value) is 3 lux and whose vertical illuminance (minimum value) is 0.5 lux as the brightness at which the crime prevention effect can be expected. Concurrently, it is also requested to reduce the cost of mounting a street light and economically obtain light distribution of a wide range by widening the mounting interval of street lights as much as possible.

To satisfy the request, for example, in an illumination device for outdoors disclosed in Jpn. Pat. Appln. KOKAI Publication No. 2004-200102, a plurality of white light emitting diodes are used as a light source. This conventional illumination device for outdoors has a plurality of flat print boards on which the plurality of white light emitting diodes are mounted. The print board is attached to mounting hardware in an attitude such that the white light emitting diodes are directed downward and moreover in multiple directions.

However, a light emitting diode is a point source of light in which the shape of a light emitting part is small. Consequently, to obtain a luminous intensity distribution over a wide range by using light emitting diodes, a number of light emitting diodes have to be arranged. For this reason, a problem in cost occurs, the structure of the illumination device for outdoors is made more complex, and it cannot be avoided that the work of assembling the illumination device for outdoors becomes troublesome.

Therefore, if using a large number of light emitting diodes as a light source, how to arrive at an illumination device for outdoors which can distribute light over a wide range while simplifying the arrangement of light emitting diodes is an important issue.

Further, as regards a light emitting diode, despite the small shape of a light emitting part, the light intensity is high. Consequently, as disclosed in the Jpn. Pat. Appln. KOKAI publication, the light emitting part of the illumination device for outdoors using a number of light emitting diodes for illumination in multiple directions has a high brightness, which tends to produce glare to those looking at it.

BRIEF SUMMARY OF THE INVENTION

An object of the present invention is to obtain a light source module which can distribute light over a wide range while simplifying the arrangement of light emitting elements, and which realizes reduced glare.

Another object of the present invention is to obtain an illumination apparatus having a light source module which can distribute light over a wide range while simplifying arrangement of light emitting elements and which realizes reduced glare.

To achieve the object, a light source module according to a first aspect of the present invention includes a reflector having a light reflection face, and a plurality of light emitting elements. The light reflection face is curved in a circular arc shape in a width direction of the reflector and extends in a longitudinal direction of the reflector. The light emitting elements are arranged in a center portion in the width direction of the light reflection face, and are arranged linearly along the longitudinal direction of the reflector.

In the first aspect of the invention, as the light emitting elements, light emitting diodes or a semiconductor laser using a semiconductor as a light generation source can be used. As the light emitting diode, a light emitting diode of an SMD (Surface Mount Device) type can be used. The number of the light emitting elements can be arbitrarily selected according to the luminous intensity distribution to be obtained. Although it is preferable for the plurality of light emitting elements to have the same function and the same performance, the functions and performances may be different from one another.

According to the first aspect of the invention, the light emitting elements arranged linearly are reflected in the light reflection face of the reflector. An image of the light emitting elements reflected in the light reflection face is expanded in association with the curvature of the light reflection face. As a result, the light emitting elements can be made to look larger, and the glare experienced when viewing the light emitting elements can be reduced.

In a second aspect of the invention, the light reflection face of the reflector has two reflection regions disposed symmetrically with the light emitting elements arranged linearly therebetween. Preferably, the light reflection face is finished as a mirror face. Light emitted from the light emitting elements toward the light reflection face is reflected by the two reflection regions to the outside of the reflector.

In a third aspect of the invention, the light source module further includes a module substrate on which the light emitting elements are mounted. The light emitting elements have an optical axis extending in a direction orthogonal to the module substrate. The reflection regions in the light reflection face reflect light from the light emitting elements toward the optical axis.

According to the third aspect of the invention, light emitted from the light emitting elements toward the light reflection face is reflected by the two reflection regions and, after that, emitted to the outside of the reflector along the optical axis. Consequently, the light emitted from the light emitting elements can be emitted effectively without wasting it.

To achieve the object, a light source module according to a fourth aspect of the invention has a module substrate, a plurality of light emitting elements, and a reflector. The light emitting elements are arranged linearly and mounted on the module substrate. The reflector includes: an opening extending in an arrangement direction of the light emitting elements and having a pair of peripheries facing each other with the light emitting elements therebetween; a first irradiation port facing the opening; a light reflection face extending from the peripheries of the opening so as to gradually expand toward the first irradiation port; a reflection wall disposed at one end along the arrangement direction of the light emitting elements so as to cross the light reflection face; and a second irradiation port facing the reflection wall at the other end along the arrangement direction of the light emitting elements.

In the fourth aspect of the invention, as the light emitting elements, light emitting diodes or a semiconductor laser using a semiconductor as a light generation source can be used. As the light emitting diode, a light emitting diode of an SMD (Surface Mount Device) type can be used. The number of the light emitting elements can be arbitrarily selected according to the light distribution to be obtained. Although it is preferable for the plurality of light emitting elements to have the same function and the same performance, the functions and performances may be different from one another.

The face facing the light emitting elements of the reflection wall may be flat, a curved face which curves so as to project toward the light emitting elements, or a curved face which is recessed with distance from the light emitting elements.

The light reflection face is, preferably, finished as a mirror face by forming, for example, a light reflection film made of a metal such as aluminum or silver on the surface of a mold made of a synthetic resin, thus constructing the reflector.

According to the fourth aspect of the invention, light emitted from the light emitting elements goes to the outside of the reflector via the first and second irradiation ports. Consequently, while preventing light leakage to a place where illumination is unnecessary, light can be emitted efficiently.

In a fifth aspect of the invention, the reflector is fixed on the module substrate, and the light emitting elements are exposed on the light reflection face via the opening in the reflector. Therefore, the module substrate and the reflector can be handled as a single assembly.

In a sixth aspect of the invention, the light reflection face has two reflection regions disposed symmetrically with the light emitting elements arranged linearly therebetween. The reflection regions are curved so that the light emitting elements reflected in the light reflection face appear larger, and the reflection wall has a flat face that continues to the reflection regions.

According to the sixth aspect of the invention, the light emitting elements are reflected in each of the two reflection regions, and an image of the reflected light emitting elements can be made look larger. Therefore, the glare experienced when viewing the light emitting elements can be further reduced.

In a seventh aspect of the invention, the light emitting elements arranged linearly are away from the focal point of the light reflection face. Consequently, light of the light emitting elements reflected by the light reflection face is expanded and emitted by the light reflector, and a luminous intensity distribution in a wide range can be obtained.

To achieve the object, an illumination apparatus according to an eighth aspect of the invention has an apparatus body, a frame, and a plurality of light source modules. The frame is supported by the apparatus body. The frame includes first and second attachment parts. The first and second attachment parts face each other tilted in opposite directions. The first and second attachment parts have attachment faces positioned on the side opposite to rear faces facing each other. A plurality of light source modules are arranged on the attachment face of the first attachment part and the attachment face of the second attachment part. Each of the light source modules includes: a module substrate fixed on each of the attachment faces; a plurality of light emitting elements mounted on the module substrate; and a reflector. The light emitting elements are arranged linearly in a direction crossing an arrangement direction of the light source modules. The reflector has: an opening extending in an arrangement direction of the light emitting elements and having a pair of peripheries facing each other with the light emitting elements therebetween; a first irradiation port facing the opening; a light reflection face extending from the peripheries of the opening so as to gradually expand toward the first irradiation port; a reflection wall disposed at one end along the arrangement direction of the light emitting elements so as to cross the light reflection face; and a second irradiation port facing the reflection wall at the other end along the arrangement direction of the light emitting elements.

The illumination apparatus according to the eighth aspect of the invention is assumed to be used as an illumination apparatus for outdoors such as a street light illuminating a road, a park, or the like. However, the present invention is not limited to this use. The illumination apparatus can be also used as an illumination apparatus for indoors mounted, for example, in a linearly extending place such as a corridor in a house, or an aisle.

In the case of using the illumination apparatus according to the eighth aspect of the invention as, for example, a street light, preferably, by emitting light obliquely downward from both sides sandwiching the linearly arranged light emitting elements, a luminous intensity distribution such that light reaches a wide range along the longitudinal direction of a road is obtained.

In the illumination apparatus according to the eighth aspect of the invention, by making the first and second irradiation ports of the reflector oriented downward, upward light from the light emitting elements can be reflected downward by the reflection wall. For this reason, light leakage to the sky is prevented, and an adverse influence on the natural environment and the living space can be prevented. Simultaneously, by efficiently guiding light to a place below the illumination apparatus where illumination is necessary, brightness in the place below the illumination apparatus can be assured.

In the illumination apparatus according to the eighth aspect of the invention, preferably, the apparatus body is made of a metal such as an aluminum die cast or a synthetic resin having a light blocking effect to block light traveling upward from the illumination apparatus. However, in a region around the illumination apparatus where brightness is high, as long as an adverse influence on the natural environment and living space does not occur, light leakage upward of the illumination apparatus is allowed.

The illumination apparatus according to the eighth aspect of the invention is mounted in an attitude in which the first and second irradiation ports of the reflector face downward, and the first and second attachment parts of the reflector tilt so as to become closer toward the second irradiation port. With such arrangement, the plurality of light emitting elements provided for each of the light source modules are just arranged linearly in a direction crossing the arrangement direction of the light source modules. Therefore, arrangement of the light emitting elements can be simplified.

Moreover, since each light source module has the light reflection face, distribution of light emitted by the light emitting element can be controlled by the light reflection face. In addition, the light source modules are disposed in the first and second attachment parts tilted in opposite directions. Consequently, light from the light source modules is emitted so as to expand as it travels to a place below the light source modules.

Further, the light reflection face expands toward the first irradiation port from the peripheries of the opening facing each other with the light emitting elements therebetween, so that the light emitting elements are reflected in the light reflection face and an image of the light emitting elements reflected in the light reflection face is made large. Therefore, the glare experienced when a person looks at the light emitting elements can be reduced.

In the eighth aspect of the invention, in the case of orienting the first and second irradiation ports of the reflector downward, the first and second attachment parts are disposed so as to be arranged in a V shape. The first and second attachment parts do not have to be disposed in a V shape but may be disposed so that the irradiation directions of light from the plurality of light source modules become symmetrical with respect to the frame as a center.

In a ninth aspect of the invention, the light reflection face has two reflection regions disposed symmetrically with the light emitting elements arranged linearly therebetween. The reflection regions are curved so that the light emitting elements reflected in the light reflection face appear larger, and the reflection wall has a flat face continuing to the reflection region.

According to the ninth aspect of the invention, the light emitting elements are reflected in each of the two reflection regions, and an image of the light emitting elements reflected can be made look larger. Therefore, the glare experienced when a person looks at the light emitting elements can be further reduced.

According to a tenth aspect of the invention, the illumination apparatus further includes a translucent cover supported by the apparatus body so as to cover the frame and the light source module. The translucent cover includes: a first light transmission part which covers a first irradiation port of a light source module arranged in the first attachment part; a second light transmission part which covers a second irradiation port of the light source module arranged in the first attachment part; a third light transmission part which covers a first irradiation port of the light source module arranged in the second attachment part; and a fourth light transmission part which covers a second irradiation port of the light source module arranged in the second attachment part.

In the tenth aspect of the invention, the translucent cover can be made of, for example, a synthetic resin material such as a transparent acrylic resin or polycarbonate, or a transparent glass. Further, the translucent cover may be made of, for example, a material of milky white color having a light diffusion property. In addition, the translucent cover may have, at least partly, a configuration for controlling light distribution, such as a prism. The configuration for controlling light distribution is not always necessary, and a function of controlling light distribution may be omitted from the translucent cover.

According to the tenth aspect of the invention, light emitted from the light source modules arranged in the first attachment part in the frame passes through the first and second light transmission parts in the translucent cover. Similarly, light emitted from the light source modules arranged in the second attachment part in the frame passes through the third and fourth light transmission parts in the translucent cover.

In an eleventh aspect of the invention, the first and third light transmission parts are disposed so as to be almost orthogonal to an emission direction of light emitted from the first irradiation port, and the second and fourth light transmission parts are disposed so as to be almost orthogonal to an emission direction of light emitted from the second irradiation port.

In the eleventh aspect of the invention, the sentence "the first to fourth light transmission parts are almost orthogonal to an emission direction of light" refers to the fact that reflection of light hardly occurs in the first to fourth light transmission parts when light passes through the first to fourth light transmission parts. Consequently, the first to fourth light transmission parts may be strictly orthogonal to the light emission direction geometrically, or not strictly orthogonal, and the crossing angle may be slightly deviated.

According to the eleventh aspect of the invention, light traveling from the light emitting elements toward the first to fourth light transmission parts is hardly reflected and passes through the first to fourth light transmission parts. Therefore, loss of light at the time of passing through the translucent cover is reduced, and the light can be efficiently emitted outside of the translucent cover.

In a twelfth aspect of the invention, a light intensity distribution along the arrangement direction of the light source modules when a vertical line is a reference is such that the total flux lies in a range of 0° to ±50° from the vertical line, the luminous flux distribution rate at 0° to less than ±20° from the vertical line is 50% to 60%, and the luminous flux distribution rate in the range of ±20° to ±50° from the vertical line is 40% to 50%.

According to the twelfth aspect of the invention, a surface to be illuminated which is positioned just below the illumination apparatus can be illuminated with a spot light of high intensity. Therefore, horizontal illuminance just below the illumination apparatus can be efficiently increased, and the brightness just below the illumination apparatus becomes sufficient. As a result, glare experienced when a person looks up at the illumination apparatus is reduced. For example, when the illumination apparatus is used as a street light, the glare rating, based on an index of glare, can be reduced.

In a thirteenth aspect of the invention, a light intensity distribution along a direction orthogonal to an arrangement direction of the light source modules when a vertical line is a reference is such that the luminous flux distribution rate at 0° to less than ±20° from the vertical line is 10% to 20%, the luminous flux distribution rate at ±20° to less than ±50° from the vertical line is 35% to 45%, the luminous flux distribution rate at ±50° to less than ±90° from the vertical line is 35% to 45%, and the luminous flux distribution rate at ±90° to less than ±180° from the vertical line is less than 5%.

According to the thirteenth aspect of the invention, for example, in the case of illuminating a road, light can be distributed so as to expand along the longitudinal direction of the road. Consequently, the road can be illuminated over a wide range, and horizontal illuminance can be increased by the distribution of light to a place just below the illumination apparatus. Therefore, the brightness just below the illumination apparatus becomes sufficient, and glare experienced when a person looks up at the illumination apparatus is reduced. Therefore, for example, in the case of using the illumination apparatus as a street light, the glare rating, based on an index of glare, can be set to 50 or less.

In addition, distribution of light upward of the illumination apparatus becomes less than 5%, and light leakage to the sky is prevented. Thus, an adverse influence on the natural environment and the living space can be reduced.

In a fourteenth aspect of the invention, the first and second light transmission parts are continued to each other, and the third and fourth light transmission parts are continued to each other.

According to the fourteenth aspect of the invention, by the light emitted from the light emitting elements, four parts of the translucent cover can be made to shine. Consequently, sufficient light can be led to places needing illumination and the appearance of the illumination apparatus which is turned on is characteristic.

In a fifteenth aspect of the invention, the reflector of each of the light source modules has a plurality of fixing parts overlapping the first and second attachment parts of the frame. The fixing parts are projected from the reflector along a direction orthogonal to the arrangement direction of the light source modules.

According to the fifteenth aspect of the invention, the fixing part is not interposed between neighboring light source modules, so that the interval between the neighboring light source modules can be narrowed. Thus, the illumination apparatus can be formed more compactly.

Moreover, a plurality of light source modules are integrally continued without being interrupted in the arrangement direction. Consequently, the plurality of light source modules can be made to appear as a linear light source extending in the arrangement direction.

In a sixteenth aspect of the invention, the reflector has a width along the arrangement direction of the light source modules, and the fixing parts are positioned in a range of the width of the reflector.

According to the sixteenth aspect of the invention, the plurality of light source modules can be arranged without intervals. Thus, wasted space can be eliminated from the light source modules, which is advantageous in making the illumination apparatus more compact.

In a seventeenth aspect of the invention, the module substrate of the light source module has an outer periphery sandwiched between the frame and the reflector, and a plurality of engagement parts formed in the outer periphery. The reflector has a plurality of projections which engage with the engagement parts, thereby determining relative positions between the reflector and the module substrate, and a plurality of retaining nails which retain the outer periphery of the module substrate, thereby holding the module substrate in the reflector.

According to the seventeenth aspect of the invention, a plurality of light emitting elements arranged linearly can be assembled in appropriate positions in the light reflection face of the reflector with high precision. Simultaneously, the module substrate and the reflector in an assembled state can be attached to the frame. Therefore, the work of assembling the illumination apparatus can be performed easily.

In addition, the light emitting elements are disposed in the opening in the reflector and exposed on the light reflection face. Consequently, for example, even when heat is generated during light-on of the light emitting elements, i.e., the light emitting diodes, dissipation of heat from the light emitting elements is not disturbed by the reflector. In particular, if the first and second irradiation ports of the reflector are directly open to the atmosphere, heat of the light emitting elements can be dissipated from the first and second irradiation ports to the atmosphere. Therefore, heat of the light emitting elements tends not to build up on the inside of the light reflection face, which is preferable from the viewpoint of suppressing a temperature rise in the light emitting element.

In an eighteenth aspect of the invention, the frame and the reflector are made of a metal, and the light emitting elements are thermally connected to the frame and the reflector via the module substrate.

According to the eighteenth aspect of the invention, for example, in the case where the light emitting elements are light emitting diodes accompanying heat generation during light-on, the heat of the light emitting diodes can be transmitted from the module substrate to the frame and the reflector. Thus, the frame and the reflector can be utilized as a heat sink that helps dissipate heat from the light emitting diodes.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

A first embodiment of the present invention will be described below with reference to FIGS. 1 to 7A and 7B.

Figure 1:
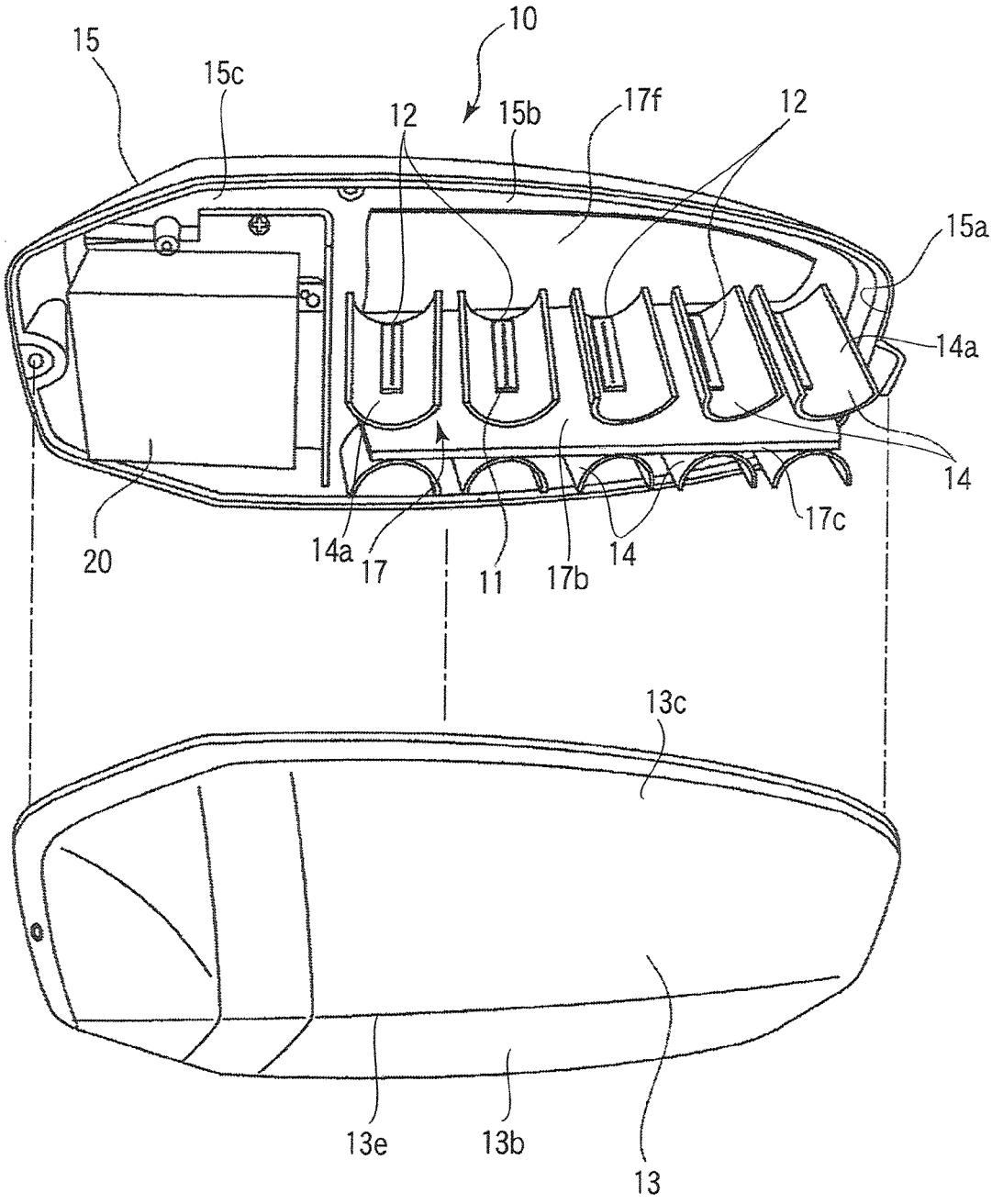
FIG. 1 is a perspective view of a street light showing a state where a translucent cover is detached from a apparatus body in a first embodiment of the present invention.
Figure 2:
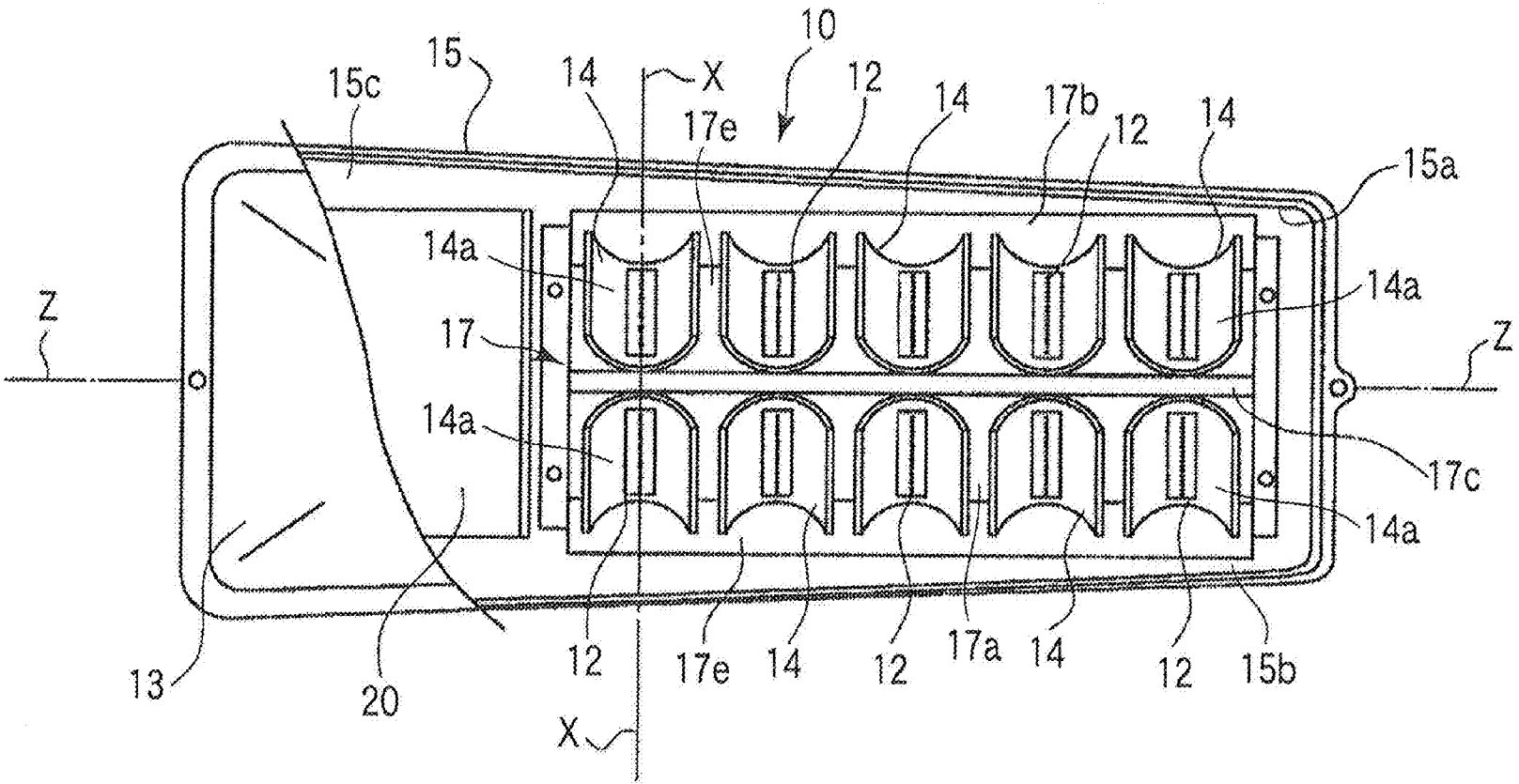
FIG. 2 is a front view of the street light with a partly-cutaway translucent cover in the first embodiment of the invention.
Figure 3:
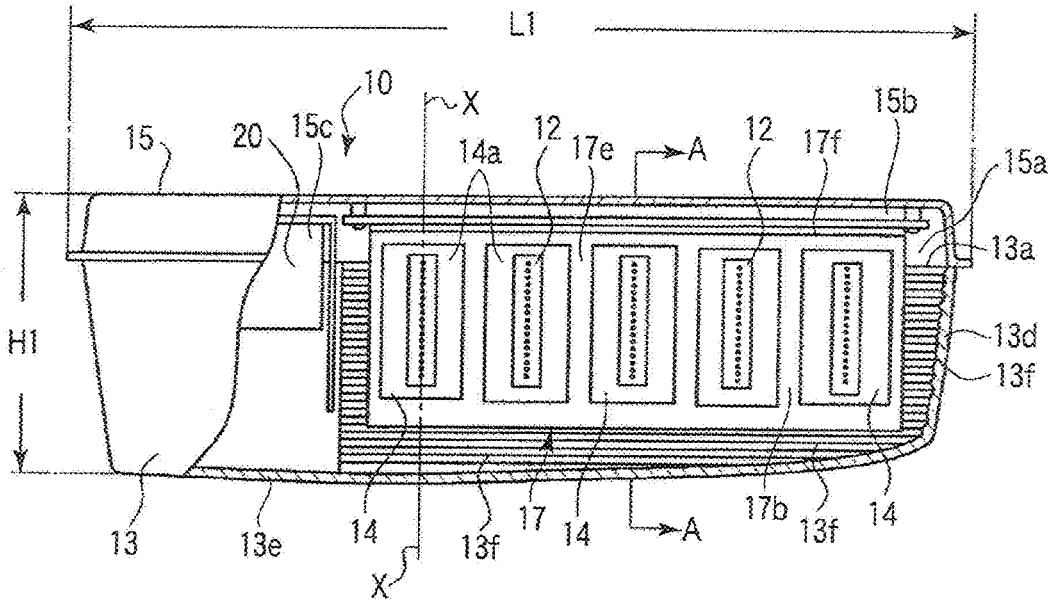
FIG. 3 is a cross section of the street light in the first embodiment of the invention.

FIGS. 1 to 3 show a street light 10 as an example of an outdoor illumination apparatus. The street light 10 includes, for example, ten light source modules 12, a translucent cover 13, a frame 17, and a apparatus body 15. Each of the light source modules 12 has a plurality of light emitting diodes 11 (hereinbelow, called LEDs) and a reflector 14. The LED 11 is an example of a semiconductor light emitting element, and the LEDs 11 all have the same performance. In the embodiment, as each of the LEDs, an LED as a high-brightness, high-output SMD type for emitting white light by a blue LED chip and a yellow phosphor excited by the blue LED chip is used.

Figure 6A:
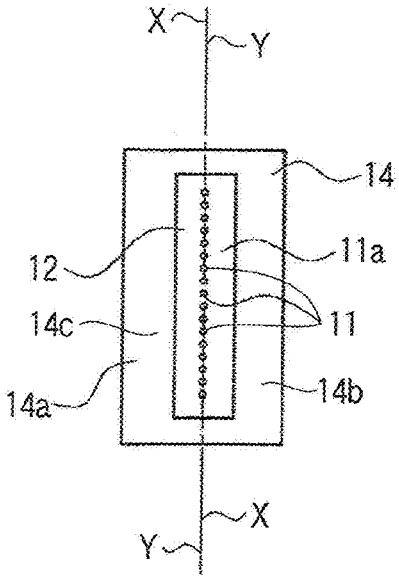
FIG. 6A is a plan view of a light source module used in the first embodiment of the invention.
Figure 6C:
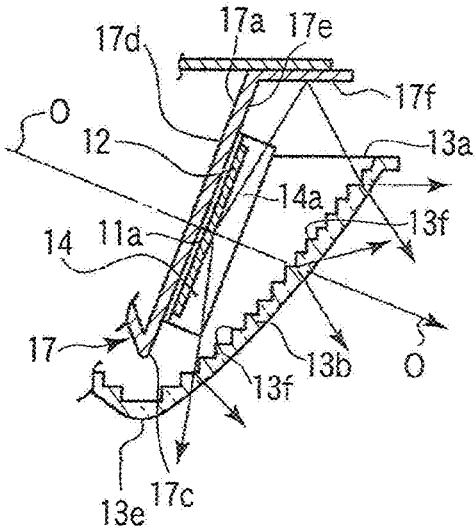
FIG. 6C is a cross section of the street light showing the positional relation between prisms formed in the translucent cover and the light source module in the first embodiment of the invention.
Figure 6B:
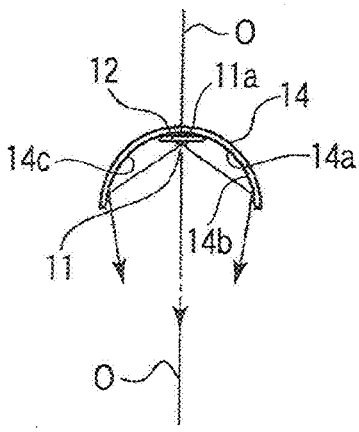
FIG. 6B is a front view of the light source module used in the first embodiment of the invention.

As shown in FIGS. 6A and 6B, the LED 11 is mounted on the mount surface of a module substrate 11*a*. Each LED 11 has an optical axis O-O. The optical axis O-O extends in a direction almost perpendicular to the mount surface of the module substrate 11*a*.

As shown in FIG. 6A, the module substrate 11*a* is a rectangular circuit board. In the embodiment, for example, twenty-four LEDs 11 are arranged almost linearly along the center line in the longitudinal direction of one module substrate 11*a*. The center line in the longitudinal direction of the module substrate 11*a* matches the center line X-X of the light source module 12. The twenty-four LEDs 11 and the module substrate 11*a* together form a linear module.

The linear module is assembled to the reflector 14. The reflector 14 is formed by, for example, a plate member of stainless steel or aluminum. As shown in FIGS. 6A to 6C, the reflector 14 extends in the longitudinal direction of the module substrate 11*a*. Both ends in the longitudinal direction of the reflector 14 are open. The sectional shape of the reflector 14, in the width direction which is orthogonal to the longitudinal direction of the reflector 14 is U shaped. The inner face of the reflector 14 is a light reflection face 14*a*. The light reflection face 14*a* is curved in an arc shape in the width direction of the reflector 14 and is given a mirror finish.

The linear module is disposed on the light reflection face 14*a* of the reflector 14. In other words, the module substrate 11*a* as a component of the linear module is within the reflector 14 and is positioned in the center portion along the width direction of the reflector 14. Further, the module substrate 11*a* is placed on the light reflection face 14*a* so as to extend in the center line Y-Y direction, which is the longitudinal direction of the reflector 14. Both ends in the longitudinal direction of the module substrate 11*a* are fixed to the reflector 14 by fixing means such as screws.

In such a manner, the LEDs 11 are positioned on the light reflection face 14*a* along the center line Y-Y of the reflector 14. As a result, the light reflection face 14*a* is divided into two reflection regions 14*b* and 14*c* sandwiching the linear module. The reflection regions 14*b* and 14*c* are disposed symmetrically with the LEDs 11 arranged linearly as a border.

Therefore, as shown in FIG. 6B, light traveling from the LED 11 toward the reflection regions 14*b* and 14*c* in the light reflection face 14*a* is reflected by the reflection regions 14*b* and 14*c* so as to follow the optical axis O-O of the LED 11.

The apparatus body 15 is, for example, an elongated box made by an aluminum die cast. The apparatus body 15 has an opening 15*a* which opens downward. As shown in FIGS. 1 to 3, the inside of the apparatus body 15 is divided into a first receptacle 15*b* and a second receptacle 15*c*. The first and second receptacles 15*b* and 15*c* are arranged in the longitudinal direction of the apparatus body 15. The first receptacle 15*b* has a space wider than that of the second receptacle 15*c*.

The first receptacle 15*b* houses the frame 17. The second receptacle 15*c* houses a lighting device 20 for controlling the light source modules 12. The frame 17 is provided to support the ten light source modules 12 and is constructed of, for example, a plate member of stainless steel or aluminum. The frame 17 is supported at the bottom of the apparatus body 15 so as to be positioned on the center line Z-Z in the longitudinal direction of the apparatus body 15.

Figure 5:
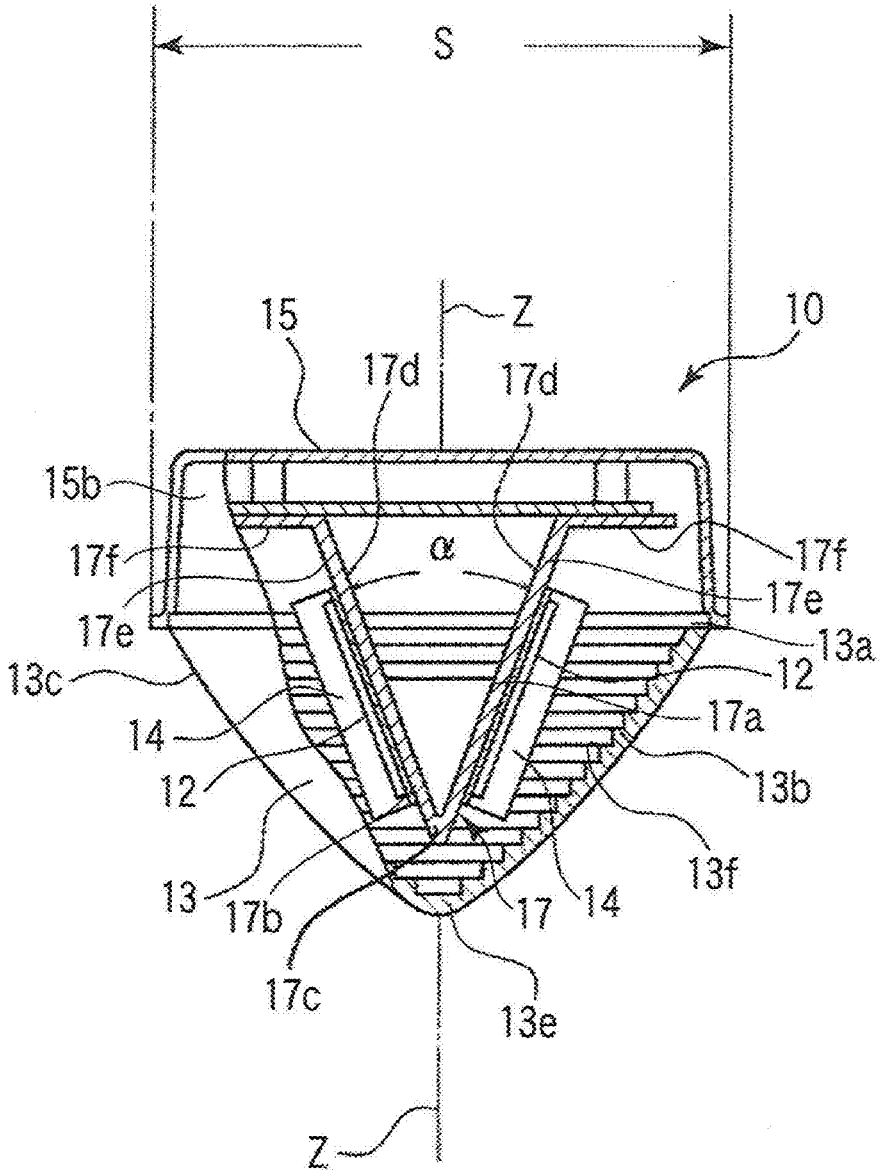
FIG. 5 is a cross section taken along line A-A of FIG. 3.

As shown in FIGS. 2 and 5, the frame 17 has a first attachment part 17*a* and a second attachment part 17*b*. Each of the first and second attachment parts 17*a* and 17*b* has a rectangular plate shape extending in the longitudinal direction of the apparatus body 15. The first and second attachment parts 17*a* and 17*b* face each other so as to be tilted in opposite directions.

Concretely, the first and second attachment parts 17*a* and 17*b* are disposed tilted so as to be apart from each other toward the apparatus body 15 and symmetrically with respect to the center line Z-Z in the longitudinal direction of the apparatus body 15. Consequently, when the frame 17 is viewed from the longitudinal direction of the apparatus body 15, the first and second attachment parts 17*a* and 17*b* are disposed in a V shape at a predetermined angle $\alpha$. In such a manner, the frame 17 is tapered downward of the apparatus body 15. The lower end of the first attachment part 17*a* and the lower end of the second attachment part 17*b* form a ridge 17*c* of the frame 17 in cooperation with each other.

Further, the first and second attachment parts 17*a* and 17*b* have rear faces 17*d* and attachment faces 17*e*. The rear face 17*d* of the first attachment part 17*a* and the rear face 17*d* of the second attachment part 17*b* face each other. The attachment faces 17*e* are positioned on the side opposite to the rear faces 17*d* and are exposed to the outside of the frame 17. In the embodiment, for example, a mirror-like finish is performed on the attachment faces 17*e* of the first and second attachment parts 17*a* and 17*b*. As a result, the frame 17 also has a function as a light reflecting member.

As shown in FIGS. 1 and 2, the first attachment part 17*a* of the frame 17 supports five light source modules 12. Similarly, the second attachment part 17*b* of the frame 17 supports five light source modules 12. The light source modules 12 are arranged in one line at intervals in the longitudinal direction of the first and second attachment parts 17*a* and 17*b*.

In other words, the light source modules 12 are arranged at intervals in the direction almost orthogonal to the arrangement direction of the LEDs 11. The intervals between the neighboring light source modules 12 are preferably equal intervals. The light source modules 12 are fixed to the frame 17 by, for example, spot-welding the center portion in the width direction of the reflector 14 to the attachment faces 17*e* of the first and second attachment parts 17*a* and 17*b*.

In such a manner, the ten light source modules 12 are disposed so as to be symmetrical around the center line Z-Z in the longitudinal direction of the apparatus body 15. The linear module specified by the LEDs 11 and the reflectors 14 extend straight in the vertical direction when the street light 10 is seen from a side as shown in FIG. 3.

As shown best in FIGS. 5 and 6C, the frame 17 has a pair of auxiliary reflectors 17*f*. The auxiliary reflectors 17*f* are integrally formed at the upper end of the first attachment part 17*a* and the upper end of the second attachment part 17*b*. The auxiliary reflectors 17*f* extend almost horizontally from the upper ends of the first and second attachment parts 17*a* and 17*b* so as to cover the bottom of the apparatus body 15 from beneath. Further, the auxiliary reflectors 17*f* face the upper ends of the light source modules 12. The under faces of the auxiliary reflectors 17*f* facing the light source modules 12 are finished, for example, as light reflection faces by mirror-like finishing.

Consequently, as shown by an arrow in FIG. 6C, light emitted from the LED 11 toward the apparatus body 15 is reflected by the auxiliary reflector 17*f* downward from the apparatus body 15.

The translucent cover 13 is used to control the light emitted from the LEDs 11 of the light source modules 12 and is made of a synthetic resin material such as transparent acrylic resin. The translucent cover 13 is an elongated box having a size corresponding to the apparatus body 15. The translucent cover 13 has an opening 13*a* which opens upward, a pair of side faces 13*b* and 13*c*, and a front end face 13*d*. The opening 13*a* has a size matching the opening 15*a* of the apparatus body 15. The side faces 13*b* and 13*c* extend in the longitudinal direction of the translucent cover 13. The front end face 13*d* is provided across the side faces 13*b* and 13*c* in a position corresponding to the first receptacle 15*b*. Further, the side faces 13*b* and 13*c* are tilted so as to be closer to each other in the downward direction. The lower ends of the side faces 13*b* and 13*c* cooperatively form a bottom part 13*e* which is tapered and peaked. Consequently, the translucent cover 13 has a V-shaped section and is widened toward the opening 13*a*.

The opening 13*a* in the translucent cover 13 fits the opening 15*a* in the apparatus body 15. By such fitment, the frame 17, the light source modules 12, and the lighting device 20 are covered with the translucent cover 13. For example, a packing (not shown) made of a silicon resin is interposed between the opening 13*a* in the translucent cover 13 and the opening 15*a* in the apparatus body 15. By use of the packing, a waterproof property of the street light 10 is assured.

Further, the translucent cover 13 is fixed to the apparatus body 15 via not-shown screws. Consequently, by unfixing the screws of the translucence cover 13 to detach the translucent cover 13 from the apparatus body 15, maintenance work on the light source modules 12 and the lighting device 20 can be executed.

As shown in FIGS. 5 and 6C, in a state where the translucent cover 13 is fixed to the apparatus body 15, the side face 13*b* of the translucent cover 13 tilts so as to be along the first attachment part 17*a* of the frame 17, and covers the five light source modules 12 fixed to the first attachment part 17*a*. Similarly, the other side face 13*c* of the translucent cover 13 tilts so as to be along the second attachment part 17*b* of the frame 17, and covers the five light source modules 12 fixed to the second attachment part 17*b*.

On the inner face of the translucent cover 13, a plurality of prisms 13*f* are integrally formed. The prisms 13*f* are provided to obtain a luminous intensity distribution over a wide range by refracting light of the LED 11 having high directivity. The apex angle of the prism 13*f* is about 90°, and the prism 13*f* has a ridge line passing the apex of the apex angle. The ridge line extends in a direction almost orthogonal to the arrangement direction of the LEDs 11 of the light source modules 12 and is continued to the side faces 13*b* and 13*c* and the front end face 13*d* of the translucent cover 13. In other words, the ridge lines of the plurality of prisms 13*f* are arranged at predetermined intervals in the direction of the center line X-X of the light source module 12 matching the arrangement direction of the LEDs 11.

In the street light 10 of the embodiment, length L1 of the apparatus body 15 shown in FIG. 3 is about 380 mm, height H1 of the apparatus body 15 including the translucent cover 13 is about 200 mm, and width S of the translucent cover 13 shown in FIG. 5 is about 170 mm.

Figure 4:
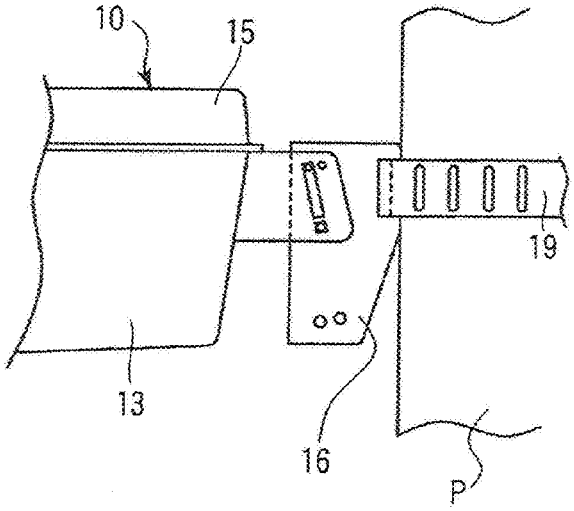
FIG. 4 is a side view showing a state where the street light is attached to an upper part of a pole via a support member in the first embodiment of the invention.

As shown in FIGS. 4 and 6, a support member 16 is attached to the apparatus body 15. The support member 16 is positioned at one end corresponding to the second receptacle 15*c* of the apparatus body 15. The support member 16 supports the street light 10 having the above-described configuration in an upper part of a pole P in cooperation with an attachment band 19 which is assembled to the support member 16. The pole P is mounted, for example, at a side of a straight road A.

Next, the action when the street light 10 is attached to the pole P and used will be described.

Figure 7A:
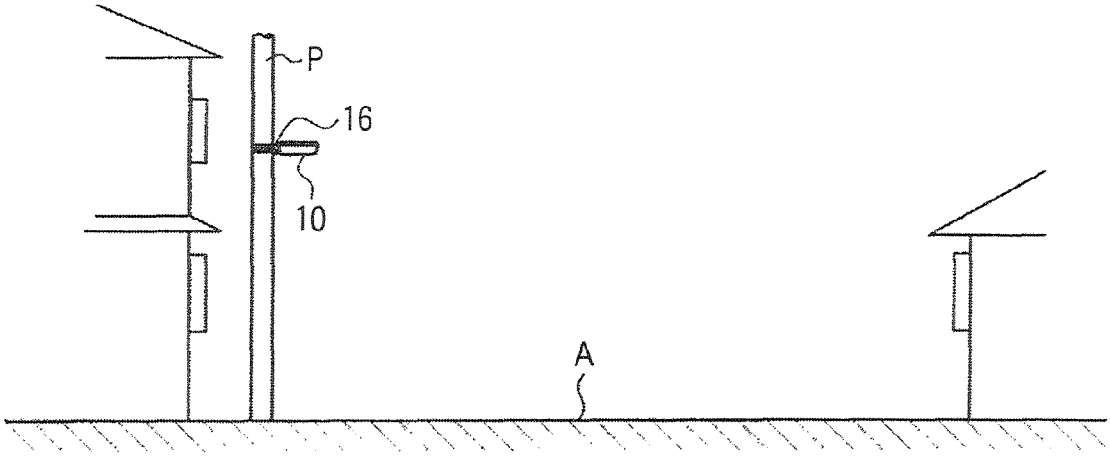
FIG. 7A is a diagram showing a state where the street light of the first embodiment of the invention is mounted on a road.

As shown in FIG. 7A, in the embodiment, the street light 10 is attached to an upper part of the pole P at a height of about 4.5 m from the surface of the road A. The street light 10 is held in an attitude so as to be almost horizontal in a direction where the center line Z-Z of the apparatus body 15 intersects the road A. Consequently, the ridge lines of the prisms 13*f* formed in the side faces 13*b* and 13*c* of the translucent cover 13 extend in a direction intersecting the road A.

Further, the first and second attachment parts 17*a* and 17*b* of the frame 17 extend almost horizontally in a direction intersecting the road A and tilt so as to be apart from each other toward the apparatus body 15 which is positioned above. Consequently, the attachment faces 17*e* of the first and second attachment parts 17*a* and 17*b* are directed obliquely downward of the apparatus body 15 so as to be symmetrical with respect to the vertical line passing through the center of the apparatus body 15. As a result, the five light source modules 12 supported by the first attachment part 17*a* and the five light source modules 12 supported by the second attachment part 17*b* are also disposed symmetrically with respect to the vertical line passing through the center of the apparatus body 15.

FIGS. 6B and 6C show paths of light emitted from the LEDs 11 when the LEDs 11 of the light source modules 12 are turned on. Light emitted along the optical axis O-O from each of the LEDs 11 is refracted by the prism 13*f* in the translucent cover 13, and the emission direction is changed downward or transversely with respect to the optical axis O-O.

Light emitted from the LED 11 to both sides of the optical axis O-O as a center are reflected by the reflection regions 14*b* and 14*c* in the reflector 14 and their emission directions are changed downward so as to follow the optical axis O-O. Further, the light traveling downward of the reflector 14 is refracted by the prism 13*f* in the translucent cover 13, and its emission direction is diffused. As a result, the light beams emitted from the light source module 12, as shown by the arrow in FIG. 7B, travel opposite to each other in the longitudinal direction of the road A with respect to the center line Z-Z of the apparatus body 15 as a center, and illuminate the surface of the road A over a wide range.

On the other hand, light emitted from the LEDs 11 of the light source modules 12 downward of the optical axis O-O as shown in FIG. 6C is refracted by the prisms 13*f* in the bottom part 13*e* of the translucent cover 13 and diffused downward from the translucent cover 13. The light emitted from the LEDs 11 of the light source modules 12 upward of the optical axis O-O is reflected by the auxiliary reflectors 17*f* of the frame 17 and its emission direction is changed to a downward direction. The light reflected by the auxiliary reflectors 17*f* is refracted by the prisms 13*f* of the side faces 13*b* and 13*c* of the translucent cover 13 and diffused downward from the translucent cover 13. The light traveling downward from the translucent cover 13 illuminates an area just below the street light 10 in the road A.

As a result, since the light diffused by the prism 13*f* travels downward from the street light 10, the area just below the street light 10 can be illuminated with a soft light. In addition, when a person looks up at the street light 10, he/she is not dazzled. Therefore, a luminous intensity distribution which is safe for eyes can be obtained.

The LEDs 11 assembled in the reflector 14 are disposed in the center portion in the width direction of the light reflection face 14*a* on the inside of the light reflection face 14*a* which curves in a circular arc shape. With this arrangement, the line of the LEDs 11 arranged linearly is reflected in each of the two reflection regions 14*b* and 14*c* in the light reflection face 14*a*. Each of the images of the LEDs 11 reflected in the reflection regions 14*b* and 14*c* is expanded and larger than the size of the actual LED 11. That is, the existence of the light reflection face 14*a* makes it appear as if there are more LEDs 11 than there actually are, and makes each of the LEDs 11 look larger. Therefore, although each of the LEDs 11 is a point light source of high brightness, glare can be reduced.

Figure 7B:
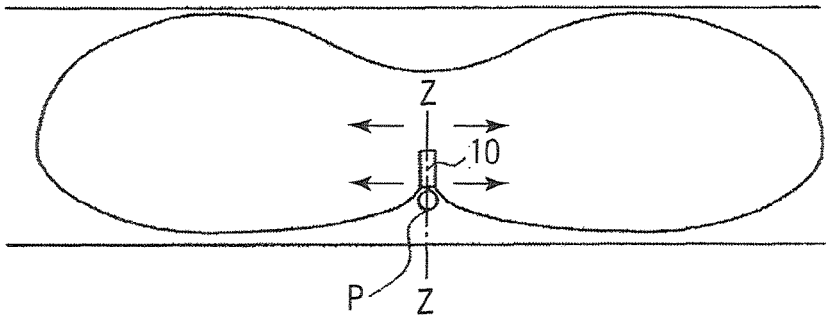
FIG. 7B is a diagram schematically showing a luminous intensity distribution of the street light in the first embodiment of the invention.

In the light source module 12 of the embodiment, the distances from the LEDs 11 arranged linearly to the reflection regions 14*b* and 14*c* in the light reflection face 14*a* are maintained uniformly. Consequently, reflection of the light reflection face 14*a* with respect to each of the LEDs 11 is controlled equally. Therefore, while widening the light from the LEDs 11 arranged linearly in the width direction of the road A, the light can be led to a far place along the longitudinal direction of the road A. With this arrangement, as schematically shown in FIG. 7B, a luminous intensity distribution over a wide range in the longitudinal direction of the road A including a region just below the street light 10, a roadway and a sidewalk can be obtained. Therefore, lighting of appropriate brightness required of the street light 10 can be realized.

In the street light 10 as the first embodiment of the present invention, the plurality of LEDs 11 are disposed linearly along the center line X-X of the light source module 12. Consequently, the structure of the light source module 12 is simplified and assembling work is also simple.

Further, in the first embodiment, light of the LED 11 having high directivity is refracted by the prism 13*f* having the ridge line extending in the direction almost orthogonal to the arrangement direction of the LEDs 11, thereby obtaining the luminous intensity distribution over a wide range. Therefore, as compared with the conventional technique using a number of expensive LEDs to obtain the luminous intensity distribution over a wide range, the problem in cost can be solved.

Further, each of the light source modules 12 has a linear module obtained by combining the LEDs 11 arranged linearly and the reflector 14. Consequently, by selecting some light source modules 12 to be turned on from the linear modules, lighting having an appropriate light intensity distribution according to the place where the street light 10 is mounted can be performed.

Concretely, for example, in the case of illuminating the end of a dead-end road, out of the five light source modules 12 attached to the first attachment part 17*a* or the five light source modules 12 attached to the second attachment part 17*b*, the light source modules 12 positioned on the side of the dead end are omitted or maintained so as not to be turned on. With this arrangement, light leakage in the direction where lighting is unnecessary is prevented, and the influence on the living space of the neighborhood and natural environment can be reduced. Therefore, the street light 10 providing an appropriate luminous intensity distribution according to a place and having excellent general versatility can be provided.

It is also possible to add a light control apparatus to the lighting device 20, select some light source modules 12 from the plurality of light source modules 12, and turn on or off the selected light source modules 12. With this arrangement, lighting for the purpose of crime prevention according to the circumstances of a place where the street light 10 is mounted such as buildings and environments around a road can be performed.

In the first embodiment of the present invention, as each of the LEDs 11, a high-brightness high-output LED of the SMD type which obtains white light by a yellow phosphor excited by a blue LED chip is used. An LED of the SMD type is constructed as a linear module having general versatility in cooperation with the module substrate 11*a*. White light emitted from the LED of the SMD type is controlled by the prism 13*f* so that the desired luminous intensity distribution can be obtained at the time of passing through the translucent cover 13. Consequently, it is unnecessary to control the luminous intensity distribution in each of a plurality of shell-type LEDs as disclosed in the above-described Jpn. Pat. Appln. KOKAI Publication, thus the present invention is more advantageous also from the viewpoint of cost.

In the first embodiment of the present invention, each of the light source modules 12 has a reflector 14. With this configuration, light emitted from the LED 11 in a direction different from the optical axis O-O can be reflected by the reflection regions 14*b* and 14*c* in the reflector 14 in a direction along the optical axis O-O. Concurrently, in the first embodiment, the auxiliary reflector 17*f* is added to the frame 17 supporting the reflector 14. The auxiliary reflector 17*f* reflects light emitted upward from the LED 11 toward the translucent cover 13. As a result, light emitted from the LED 11 in each of the light source modules 12 can be effectively utilized, and a street light 10 providing an appropriate luminous intensity distribution can be obtained.

In addition, a long-life LED 11 is used as a light emitting element, so that the frequency of maintenance such as lamp replacement can be reduced. Thus, while reducing the maintenance cost of the street light 10, the street light 10 can be used for a long time.

Further, by covering the plurality of LEDs 11 with the translucent cover 13 in which the prisms 13*f* are formed, lighting for the purpose of crime prevention which provides the luminous intensity distribution over a wide range of the road A can be realized. Therefore, the mounting interval of the street lights 10 can be widened, so that lighting for the purpose of crime prevention can be realized economically.

The LED 11 does not require a heavy, large stabilizer required by a fluorescent lamp and an HID lamp. Therefore, miniaturization and lighter weight of the street lamp 10 can be realized. For this reason, the work of mounting the street light 10 in a high place on the pole P can be performed easily, and the street light 10 can be mounted to the pole P reliably.

Five light source modules 12 are disposed in each of the first and second attachment parts 17*a* and 17*b* which are disposed in a V shape. The first and second attachment parts 17*a* and 17*b* are disposed symmetrically with respect to the center line Z-Z of the apparatus body 15. With this configuration, light emitted from the light source modules 12 can be reliably controlled so that the emission directions become symmetrical, so that a stable luminous intensity distribution can be obtained.

The plurality of light source modules 12 are supported by the frame 17 and housed in a lump in the first receptacle 15*b* in the apparatus body 15. Simultaneously, the lighting device 20 for turning on the light source modules 12 is housed in the second receptacle 15*c* in the apparatus body 15. Consequently, arrangement of the parts in the apparatus body 15 is simplified, and a street light 10 which is easily assembled can be obtained.

The apex angle of the prism 13*f* in the translucent cover 13 can be appropriately set in accordance with the positional relation with the light source module 12 and the luminous intensity distribution to be obtained. Consequently, the apex angle of the prism 13*b* is not limited to about 90° as described in the first embodiment.

In the first embodiment, the reflector 14, the frame 17, and the auxiliary reflector 17*f* are subjected to mirror-like finishing. However, in the case where the reflector 14 and the frame 17 are made of a shiny metal such as stainless steel or aluminum, the mirror-like finishing need not be performed.

Further, the reflector may be formed of a white synthetic resin material such as PBT (polybutylene terephthalate). In the case where the reflector is made of a synthetic resin, a mirror finish process or half-mirror finish process may be performed on the reflector.

In the first embodiment, all of the light source modules have reflectors. However, the present invention is not limited to this configuration. The desired luminous intensity distribution may be obtained by providing reflectors for a part of the light source modules.

The reflector may be formed integrally with another part such as an apparatus body or a module substrate. Although a plurality of reflectors are made of the same material and have the same reflection performance in the first embodiment, the present invention is not limited to the embodiment. For example, reflectors of neighboring light source modules may be formed of different materials, or the reflection performances of the reflectors of neighboring light source modules may be made different from each other. In addition, reflectors of neighboring light source modules may be integrated with each other.

In the first embodiment, the lighting device is housed in the apparatus body. However, the present invention is not limited to this arrangement. For example, the lighting device may be separated from the apparatus body and mounted in another place.

Simultaneously, the translucent cover may not be fixed to the apparatus body by screws. For example, one end of the translucent cover may be coupled to an opening in the apparatus body via a hinge. With this configuration, the translucent cover can swing between a closed position in which the translucent cover covers the opening in the apparatus body and an open position in which the translucent cover opens the opening in the apparatus body. Consequently, it is unnecessary to detach the translucent cover from the apparatus body at the time of performing maintenance on the lighting device and the light source modules. Therefore, the work required by the maintenance on the lighting device and the light source modules can be performed easily.

The light emitting element is not limited to an LED semiconductor light emitting element. In place of an LED, another light source such as a cold-cathode lamp, a halogen lamp, or an EL (electroluminescence) may be used.

In the first embodiment, the street light is supported in the upper part of the pole so that the ridge lines of prisms in the translucent cover extend in the direction crossing the road. However, the ridge lines of the prisms do not have to strictly extend in the direction crossing the road geometrically. For example, the ridge lines of the prisms may extend at an angle slightly deviated in the longitudinal direction of a road from the direction crossing the road in accordance with circumstances of the place where the street light is to be mounted.

Second Embodiment

Figure 8A:
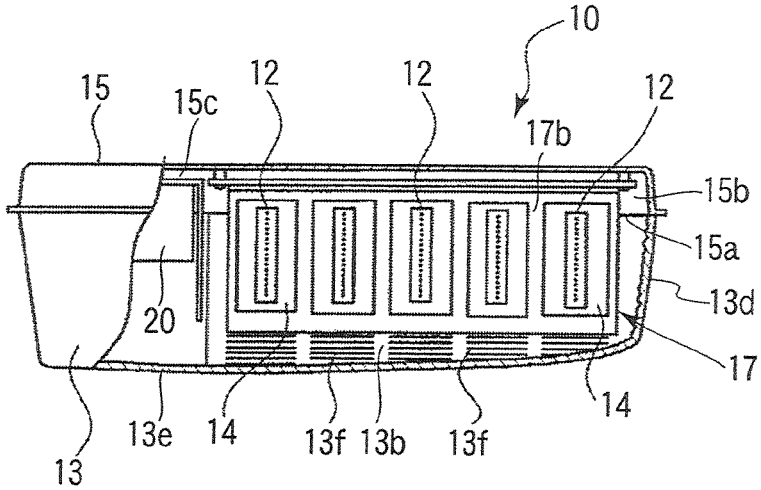
FIG. 8A is a cross section of a street light as a second embodiment of the invention.

FIG. 8A discloses a second embodiment of the present invention. The second embodiment is different from the first embodiment with respect to matters related to the prism 13*f* in the translucent cover 13.

In the first embodiment, the prisms 13*f* are continuously formed in the entire side faces 13*b* and 13*c* of the translucent cover 13. In contrast, in the second embodiment, the prisms 13*f* are formed only in a plurality of places facing the light source modules 12 in the side faces 13*b* and 13*c* of the translucent cover 13. Desirably, by performing a transparent or light diffusing process, a part where no prisms 13*f* exist in the side faces 13*b* and 13*c* of the translucent cover 13 can be made semitransparent.

Third Embodiment

Figure 8B:
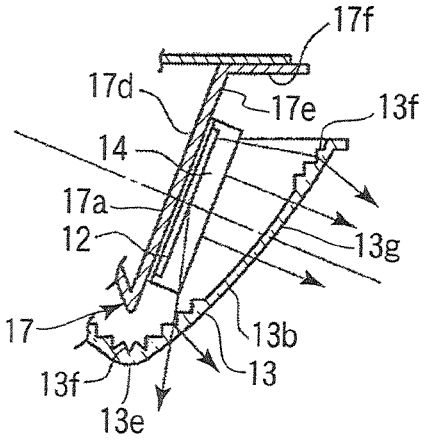
FIG. 8B is a cross section of a street light as a third embodiment of the invention.

FIG. 8B discloses a third embodiment of the present invention. In the third embodiment, the prisms 13*f* are formed in a region except for the part facing the light source modules 12 in the side faces 13*b* and 13*c* of the translucent cover 13. That is, a part facing the light source modules 12 in the side faces 13*b* and 13*c* of the translucent cover 13 is an even and almost flat transparent part 13*g*. The prisms 13*f* are positioned on the upper and lower sides of the transparent part 13*g*.

With this configuration, light of the LEDs 11 having strong directivity passes through the transparent part 13*g* in the translucent cover 13 and is emitted to the outside of the translucent cover 11. Consequently, light of the LEDs 11 passes through the translucent cover 13 without being largely diffused, and light reaches a further place.

On the other hand, light of the LEDs 11 traveling straight down from the street light 10 is diffused by the prisms 13*f* positioned in the bottom part 13*e* of the translucent cover 13. As a result, since the light diffused by the prisms 13*f* travels down from the street light 10, the area just below the street light 10 can be illuminated with soft light. In addition, when a person looks up at the street light 10, he/she is not dazzled. Therefore, a luminous intensity distribution which is safe to the eyes can be obtained.

Further, by appropriately setting the apex angle of the prism 13*f* positioned on the upper side of the transparent part 13*g* of the translucent cover 13, light passing through the upper part in the translucent cover 13 can be refracted downward. Therefore, light leakage from the street light 10 upwards is prevented, and any influence on the living space of a neighborhood and natural environment can be reduced.

Fourth Embodiment

Figure 8C:
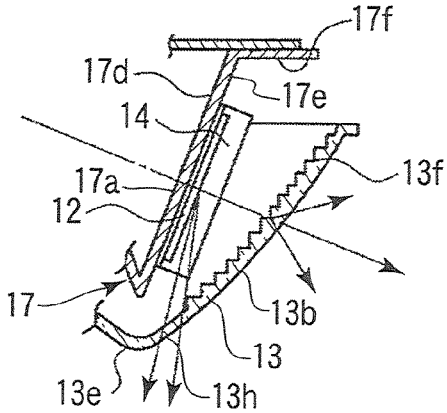
FIG. 8C is a cross section of a street light as a fourth embodiment of the invention.

FIG. 8C discloses a fourth embodiment of the present invention. In the fourth embodiment, the prisms 13*f* are formed in a region excluding the bottom part 13*e* in the inner face of the translucent cover 13. That is, the bottom part 13*e* of the translucent cover 13 facing the lower end of the light source module 12 is an even transparent part 13*h*. The transparent part 13*h* may be, for example, semitransparent.

With such a configuration, light of the LEDs 11 traveling to the area just below the street light 10 passes through the transparent part 13*h* in the translucent cover 13, so that diffusion of light is suppressed. Consequently, a spot just below the street light 10 can be illuminated, and illuminance just below the street light 10 can be sufficiently assured.

Fifth Embodiment

Figure 9A:
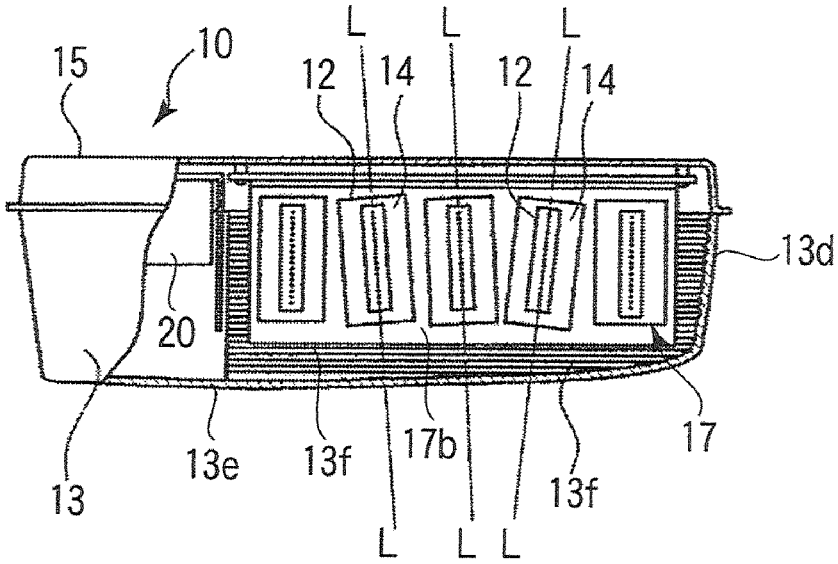
FIG. 9A is a cross section of a street light as a fifth embodiment of the invention.

FIG. 9A discloses a fifth embodiment of the present invention. The fifth embodiment is different from the first embodiment with respect to the point that the direction of each of the plurality of light source modules 12 can be adjusted.

As shown in FIG. 9A, the reflector 14 of each of the light source modules 12 is swingably supported by the first and second attachment parts 17*a* and 17*b* of the frame 17. With this arrangement, the arrangement direction L-L of the LEDs 11 can be changed in a predetermined angle range. Simultaneously, the angle of an intersection between the arrangement direction L-L of the LEDs 11 and the ridge line of the prism 13*f* can be changed.

As a result, a luminous intensity distribution of the street light 10 can be adjusted according to a place and, for example, the luminous intensity distribution suitable for a curved road or a corner of a road can be obtained.

Sixth Embodiment

Figure 9B:
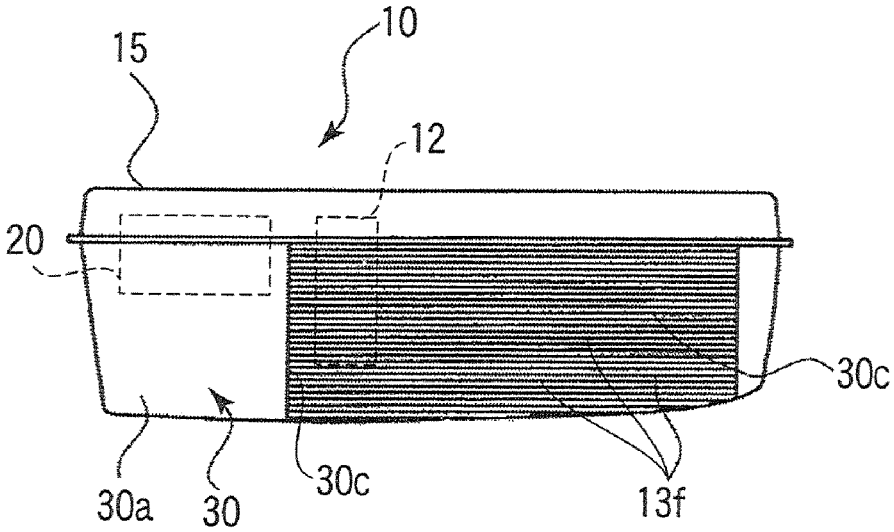
FIG. 9B is a side view of a street light as a sixth embodiment of the invention.

FIG. 9B discloses a sixth embodiment of the present invention. The sixth embodiment is different from the first embodiment with respect to matters related to a cover member 30 supported by the apparatus body 15.

As shown in FIG. 9B, the cover member 30 has a body 30*a* and a light diffusion part 30*b*. The body 30*a* covers the lighting device 20 and has an opening 30*c* in a position corresponding to the plurality of light source modules 12. The light diffusion part 30*b* is made of, for example, a transparent resin material. The light diffusion part 30*b* is fitted in the opening 30*c* in the body 30*a* and covers the light source modules 12. Further, the light diffusion part 30*b* has prisms 13*f* similar to those of the first embodiment. Consequently, the light diffusion part 30*b* solely controls distribution of light emitted from the light source modules 12.

Seventh Embodiment

Mounting intervals between outdoor illumination apparatuses such as street lights are required to be increased to realize energy saving and simplification of construction. To illuminate a road with appropriate brightness while satisfying such requirement, each street light has to have a luminous intensity distribution such that light extends along the longitudinal direction of a road.

However, in the case where a street light having a luminous intensity distribution such that light extends along the longitudinal direction of a road is mounted, for example, at a corner of a road or a curved road, a residual part of the light may travel off the road. Such residual light is leaked light, which may travel to a part where illumination is unnecessary, and may exert an adverse influence on the living space in a neighborhood and the natural environment.

A seventh embodiment of the present invention discloses a configuration of a street light which can illuminate a corner of a road and a curved road with appropriate brightness while preventing light leakage to a part where illumination is unnecessary.

With reference to FIGS. 10A and 10B and FIGS. 11A to 11E, the seventh embodiment will be described. An outdoor illumination apparatus of the seventh embodiment has a first street light R and a second street light L. When the street light of the first embodiment is divided into two parts along the center line Z-Z of the apparatus body shown in FIG. 5, the first street light R corresponds to the configuration on the right side of the center line Z-Z. Similarly, the second street light L corresponds to the configuration on the left side of the center line Z-Z of the apparatus body.

Figure 10B:
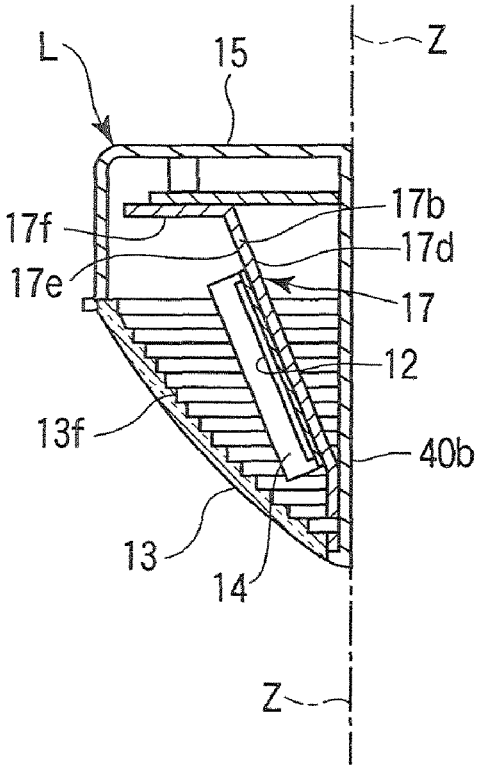
FIG. 10B is a cross section of a second street light as the seventh embodiment of the invention.
Figure 10A:
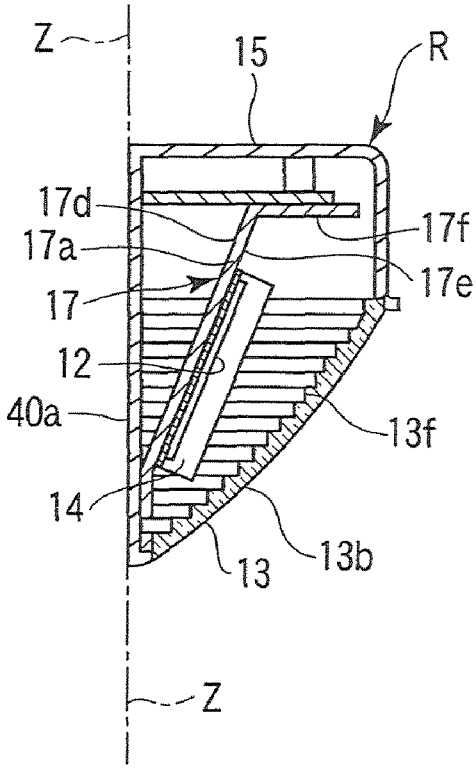
FIG. 10A is a cross section of a first street light as a seventh embodiment of the invention.

As shown in FIG. 10A, the first street light R includes the frame 17 having the first attachment part 17*a*, the five light source modules 12 supported by the first attachment part 17*a*, the translucent cover 13 in which the prisms 13*f* are formed in the side face 13*b*, and the apparatus body 15 supporting the frame 17 and the translucent cover 13.

The prism 13*f* has a ridge line passing through the apex of the apex angle. The ridge line extends in a direction almost orthogonal to the arrangement direction of the plurality of LEDs of each of the light source modules 12. A side plate 40*a* extending downward is formed integrally with the apparatus body 15. The side plate 40*a* faces the rear face 17*d* of the first attachment part 17*a* and closes an open end of the translucent cover 13. Between the translucent cover 13 and the side plate 40*a*, a packing (not shown) for assuring a waterproof property is interposed.

As shown in FIG. 10B, the second street light L includes the frame 17 having the second attachment part 17*b*, the five light source modules 12 supported by the second attachment part 17*b*, the translucent cover 13 in which the prisms 13*f* are formed in the side face 13*b*, and the apparatus body 15 supporting the frame 17 and the translucent cover 13.

The prism 13*f* has a ridge line passing through the apex of the apex angle. The ridge line extends in a direction almost orthogonal to the arrangement direction of the plurality of LEDs of each of the light source modules 12. A side plate 40*b* extending downward is formed integrally with the apparatus body 15. The side plate 40*b* faces the rear face 17*d* of the second attachment part 17*b* and closes an open end of the translucent cover 13. Between the translucent cover 13 and the side plate 40*b*, a packing (not shown) for assuring a waterproof property is interposed.

When the light source modules 12 of the first street light R are turned on, light emitted from the LEDs of the light source modules 12 passes through the translucent cover 13. The light passed through the translucent cover 13 is diffused by the prisms 13*f*. The light diffused by the prisms 13*f* is emitted obliquely downward from the translucent cover 13 so as to be away from the side plate 40*a* of the apparatus body 15.

Similarly, when the light source modules 12 of the second street light L are turned on, light emitted from the LEDs of the light source modules 12 passes through the translucent cover 13. The light passed through the translucent cover 13 is diffused by the prisms 13*f*. The light diffused by the prisms 13*f* is emitted obliquely downward from the translucent cover 13 so as to be away from the side plate 40*b* of the apparatus body 15.

Each of the first and second street lights R and L is attached to the upper part of the pole via the support member and the attachment band. In the seventh embodiment, preferably, the support member is swingable about the pole so that the first and second street lights R and L can be mounted in arbitrary positions in the circumferential direction of the pole.

Figure 11A:
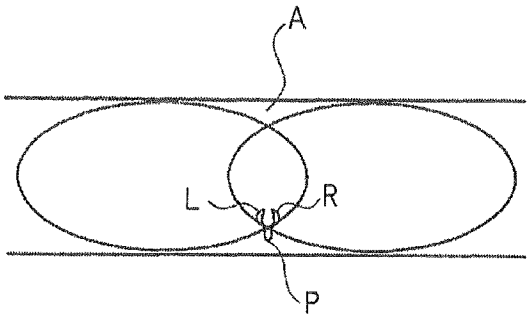
FIG. 11A is a diagram schematically showing a luminous intensity distribution when a straight road is irradiated by the first and second street lights in the seventh embodiment of the invention.

FIG. 11A schematically shows the luminous intensity distribution when the straight road A is illuminated with the first and second street lights R and L. In the case of illuminating the straight road A, the first and second street lights R and L are used for each pole P. The first and second street lights R and L are attached to the upper part of the pole P in an attitude such that their side plates 40*a* and 40*b* face each other in parallel.

In other words, the first and second street lights R and L are attached to the pole P in an attitude such that the translucent covers 13 are directed to the surface of the road A and the plurality of light source modules 12 are arranged in the direction crossing the road A. With this configuration, in a manner similar to the first embodiment, the ridge lines of the prisms 13*f* in the translucent cover 13 extend in the direction crossing the road A.

When the first and second street lights R and L are turned on, light from the light source modules 12 are emitted toward the road surface so as to be symmetrical with each other along the longitudinal direction of the road A. Consequently, as schematically shown in FIG. 11A, a luminous intensity distribution in which light expands in an oval shape from the regions below the first and second street lights R and L along the longitudinal direction of the road A including a roadway and a sidewalk is obtained. Therefore, illumination having a high crime preventing effect and appropriate brightness can be performed.

The prisms 13*f* in the translucent cover 13 control the light transmitting through the translucent cover 13 so that the light does not reach a place other than the road A.

Figure 11B:
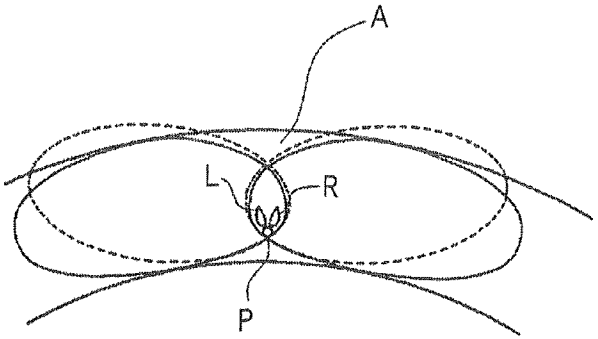
FIG. 11B is a diagram schematically showing a luminous intensity distribution when a curved road is irradiated by the first and second street lights in the seventh embodiment of the invention.

FIG. 11B schematically shows a luminous intensity distribution when the road A which is curved in a circular arc shape is illuminated with the first and second street lights R and L. Also, at the time of illuminating the curved road A, the first and second street lights R and L are used for each pole P.

As shown in FIG. 11B, the first street light R is attached to the pole P in an attitude in which the first street light R is oriented to the right side of the pole P so as to correspond to the curve of the road A. Similarly, the second street light L is attached to the pole P in an attitude in which the second street light L is oriented to the left side of the pole P so as to correspond to the curve of the road A. As a result, the first and second street lights L and R are mounted in a V shape using the pole P as a start point so as to be apart from each other with distance from the pole P in the width direction of the road A.

When the first street light R is turned on, light from the light source modules 12 is emitted to the region below the first street light R toward the road A curved on the right side of the pole P. When the second street light L is turned on, light from the light source modules 12 is emitted to the region below the second street light L toward the road A curved on the left side of the pole P. As a result, as schematically shown in FIG. 11B, a luminous intensity distribution in which light expands in an oval shape from the regions below the first and second street lights R and L along the curve of the road A including the roadway and the sidewalk is obtained.

Therefore, light emitted from the first and second street lights R and L can be prevented from being leaked to the region outside of the road A as shown by broken lines in FIG. 11B, and an adverse influence on the living space in a neighborhood and the natural environment is suppressed.

Figure 11C:
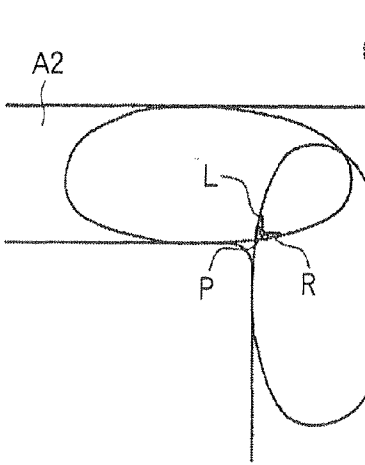
FIG. 11C is a diagram schematically showing a luminous intensity distribution when a corner of a road is irradiated by the first and second street lights in the seventh embodiment of the invention.

FIG. 11C schematically shows a luminous intensity distribution when a corner of the road A is illuminated with the first and second street lights R and L. Also at the time of illuminating a corner of the road A, the first and second street lights R and L are used for each pole P.

As shown in FIG. 11C, the first and second street lights R and L are attached to the pole P in an attitude in which they are orthogonal to each other. Specifically, the pole P is mounted at a road side at a corner of the road A. The road A has two linear parts A1 and A2 extending from the corner in directions orthogonal to each other. The first street light R is attached to the pole P in an attitude in which it crosses the first linear part A1 of the road A. The second street light L is attached to the pole P in an attitude in which it crosses the other linear part A2 of the road A.

When the first street light R is turned on, light from the light source modules 12 is emitted to the region below the first street light R toward the linear part A1 of the road A. When the second street light L is turned on, light from the light source modules 12 is emitted to the region below the second street light L toward the other linear part A2 of the road A. As a result, as schematically shown in FIG. 11C, a luminous intensity distribution in which light expands in an oval shape from the regions below the first and second street lights R and L along the two linear parts A1 and A2 including the roadway and the sidewalk is obtained. Therefore, the corner of the road A having the two linear parts A1 and A2 orthogonal to each other can be illuminated over a wide range.

Figure 11D:
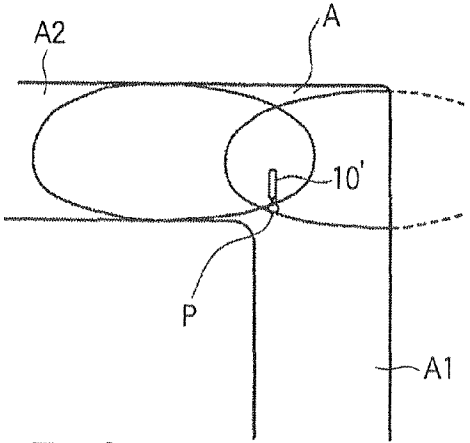
FIG. 11D is a diagram schematically showing a luminous intensity distribution when a corner of a road is irradiated by a conventional street light.

FIG. 11D schematically shows a luminous intensity distribution when a corner of the road A is illuminated with a street light 10' which symmetrically emits light in two directions. In the example shown in FIG. 11D, the street light 10' is attached to the pole P so that light emitted in one direction from the street light 10' is emitted toward the corner and the linear part A2. A part of the light emitted from the street light 10' to the other direction becomes residual light illuminating the region outside of the corner of the road A as shown by a broken line in FIG. 11D.

On the other hand, in the example shown in FIG. 11C, the first and second street lights R and L can illuminate only the corner of the road A so as to follow the two linear parts A1 and A2, so that light leakage to the region which does not require illumination can be prevented. Therefore, as compared with the example shown in FIG. 11D, an adverse influence on the living space in a neighborhood and the natural environment is suppressed.

Figure 11E:
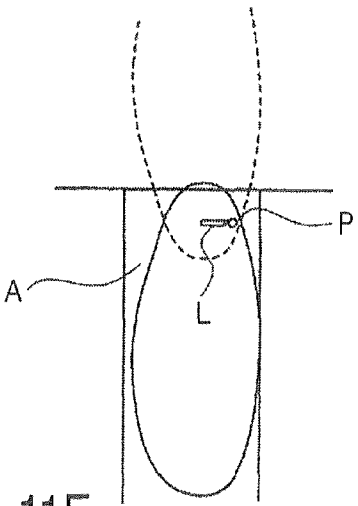
FIG. 11E is a diagram schematically showing a luminous intensity distribution when an terminating end of a road is irradiated by using the second street light in the seventh embodiment of the invention.

FIG. 11E schematically shows a luminous intensity distribution when a terminating end of the road A is illuminated with one second street light 10L. In the example of FIG. 11E, the pole P is mounted on the right side part of the terminating end of the road A. The second street light 10L is attached to the pole P in an attitude in which the side plate 40*b* is directed to the terminating end of the road A and the translucent cover 13 crosses the road A. With this arrangement, the ridge lines of the prisms 13*f* of the translucent cover 13 extend so as to cross the road A.

When the second street light L is turned on, light diffused by the prisms 13*f* is emitted to the road surface in the longitudinal direction of the road A from the terminating end of the road A. As a result, as schematically shown in FIG. 11E, the luminous intensity distribution in which light expands in an oval shape from the region below the second street light L along the extension direction of the road A including the roadway and the sidewalk is obtained. As shown by a broken line in FIG. 11E, light emitted from the second street light L does not reach the region outside of the terminating end of the road A. Therefore, light leakage to the region which does not require illumination can be prevented and an adverse influence on the living space in the neighborhood and the natural environment is suppressed.

When the pole P is mounted on the left side part of the road A at the time of illuminating the terminating end of the road A, the first street light R is used. The first street light R is attached to the pole P in an attitude in which the side plate 40*a* is directed to the terminating end of the road A and the translucent cover 13 crosses the road A. With this arrangement, a luminous intensity distribution similar to that in the case of using the second street light L can be obtained.

In the seventh embodiment, appropriate illumination according to the shape of the road A is enabled, and light leakage to a region which does not require illumination can be minimized. Further, the first and second street lights R and L having high general versatility which can easily meet conditions of a place to be illuminated can be provided.

In addition, in the seventh embodiment, it is sufficient for each of the first and second street lights R and L to emit light in one direction. Consequently, as compared mainly with the first embodiment, the number of light source modules 12 can be reduced, and the cost can be reduced. Simultaneously, the shape of each of the reflector 14 and the translucent cover 13 can be made smaller, and miniaturization and reduced weight of the first and second street lights R and L can be realized. Therefore, the work of attaching the first and second street lights R and L to the pole P can be easily performed.

In the seventh embodiment, light is diffused by the translucent cover having the prisms. The present invention is not limited to the seventh embodiment. For example, light may be diffused by a lens member such as a convex lens. Consequently, an optical system can be constructed by combination of the light source modules and lens members, or combination of the light source modules, the reflector, and the lens members.

Eighth Embodiment

FIGS. 12 to 25 disclose an eighth embodiment of the present invention. The street light 10 of the eighth embodiment is different from that of the first embodiment mainly with respect to the configuration of the light source module 12 and the translucent cover 13. The other configuration of the street light 10 is basically similar to that of the first embodiment. Consequently, in the eighth embodiment, the same reference numerals are designated to the same components as those of the first embodiment and their description will not be repeated.

In the eighth embodiment, the apparatus body 15 is made by, for example, die-cast aluminum. The frame 17 fixed to the inner face of the apparatus body 15 is made of, for example, a metal having excellent thermal conductivity such as aluminum.

Figure 15:
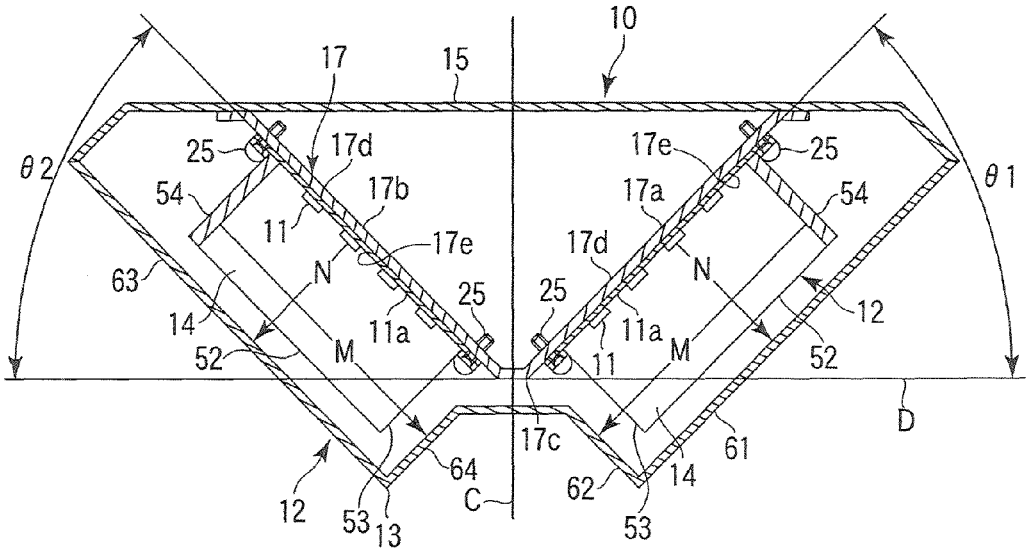
FIG. 15 is a cross section of the street light as the eighth embodiment of the invention.

As shown in FIG. 15, the frame 17 has the first attachment part 17*a*, the second attachment part 17*b*, and the ridge 17*c*. The first and second attachment parts 17*a* and 17*b* face each other so as to tilt in opposite directions. The ridge 17*c* integrally connects the lower end of the first attachment part 17*a* and the lower end of the second attachment part 17*b*. Consequently, the frame 17 is formed so that a section in the direction orthogonal to the longitudinal direction of the frame 17 has a V shape. The ridge 17*c* of the frame 17 may be sharpened or may not be sharpened. Further, the frame 17 of the eighth embodiment does not have a component corresponding to the auxiliary reflector of the frame 17 in the first embodiment.

As shown in FIG. 15, each of a tilt angle θ1 of the first attachment part 17*a* with respect to a horizontal line D orthogonal to a vertical line C passing through the ridge 17*c* and a tilt angle θ2 of the second attachment part 17*b* with respect to the horizontal line D is 30° to 60°. By setting the tilt angles θ1 and θ2 in such a manner, when the light source modules 12 are turned on, a long irradiation distance of the light emitted obliquely downward from the light source module 12 can be assured. That is, light can be emitted, for example, in the range of 17.5 m in the longitudinal direction (extension direction) of the road, which is required for the street light 10.

As shown in FIGS. 18 to 22, each of the plurality of light source modules 12 arranged on the attachment faces 17*e* of the first and second attachment parts 17*a* and 17*b* has the reflector 14, the module substrate 11*a* overlaid on the reflector 14, and the plurality of LEDs 11 mounted on the module substrate 11*a*.

Each of the reflectors 14 has a body made of a synthetic resin such as PBT or ABS. Aluminum or silver is vapor-deposited on the surface of the body. Aluminum or silver is vapor-deposited in a range of dimension E1 in FIGS. 20B, 20C, and 20D. In a range of dimension E2 as the attachment part to the frame 17 of the reflector 14, aluminum or silver is not vapor-deposited.

Each reflector 14 has the light reflection face 14*a* extending in its longitudinal direction. The light refection face 14*a* is made of aluminum or silver which is vapor-deposited on the body. With this configuration, the light reflection face 14*a* serves as a mirror face.

Figure 19A:
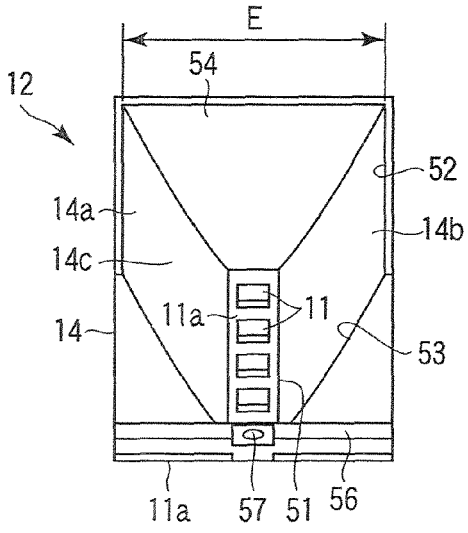
FIG. 19A is a perspective view, from below, of the light source module used in the eighth embodiment of the invention.
Figure 19B:
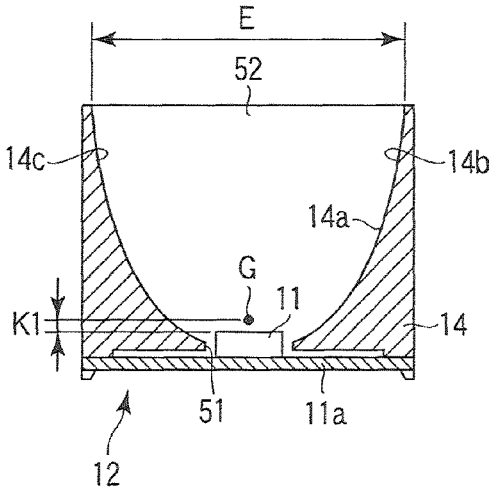
FIG. 19B is a cross section of the light source module used in the eighth embodiment of the invention.
Figure 22:
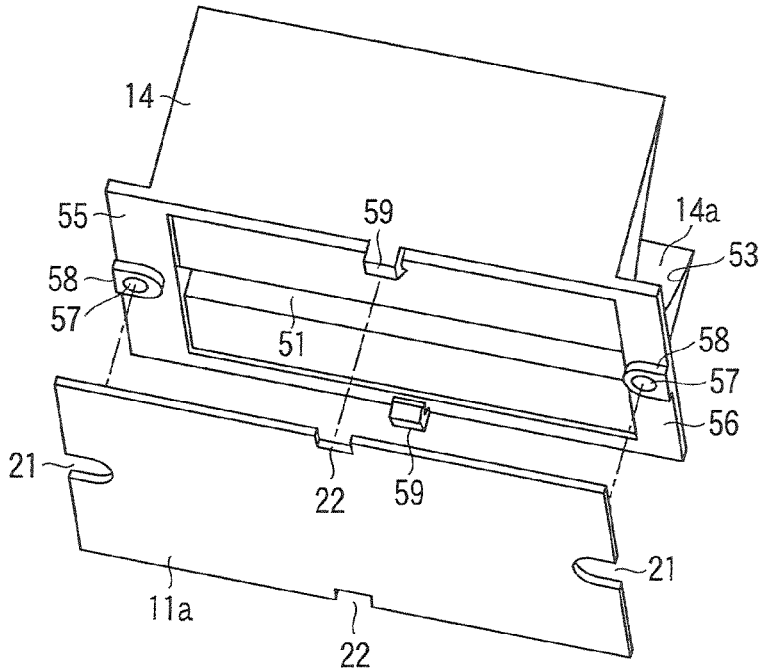
FIG. 22 is a perspective view of the light source module showing a state where the module substrate and the reflector are separated from each other in the eighth embodiment of the invention.

As shown in FIGS. 19B and 22, each reflector 14 has an opening 51, a first irradiation port 52, and a second irradiation port 53. The opening 51 is positioned in a center portion in the width direction of the light reflection face 14*a* and is formed in a slit shape extending in the longitudinal direction of the reflector 14. The opening 51 divides the light reflection face 14*a* into two reflection regions 14*b* and 14*c*. The opening 51 has a pair of edges continued to the reflection regions 14*b* and 14*c*.

The first irradiation port 52 faces the opening 51 and is continued to the light reflection face 14*a*. The reflection region 14*b* in the light reflection face 14*a* extends from one of the edges of the opening 51 toward the first irradiation port 52. The reflection region 14*c* in the light reflection face 14*a* extends from the other edge of the opening 51 toward the first irradiation port 52. The reflection regions 14*b* and 14*c* are curved in a circular arc shape so as to be apart from each other with a distance from the opening 51 toward the first irradiation port 52. Consequently, the light reflection face 14*a* gradually expands from the opening 51 toward the first irradiation port 52.

As shown in FIGS. 19A and 19B, opening width E of the first irradiation port 52 of the reflector 14 is 20 mm to 50 mm. By specifying the opening width E to such a value, the light source modules 12 and the street light 10 can be made compact. In addition, light can be led out in a desired range so that light emitted from the light source module 12 is not narrowed too much. Concretely, for example, in the illumination for a road, light can be controlled so that the entire width of the road can be illuminated.

The second irradiation port 53 is positioned at the lower end in the longitudinal direction of the reflector 14. The second irradiation port 53 is continued to the first irradiation port 52 and the light reflection face 14*a*.

Figure 20A:
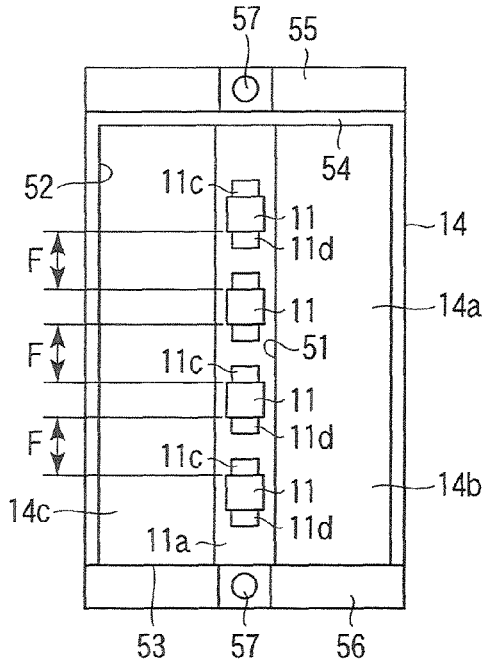
FIG. 20A is a front view of the light source module used in the eighth embodiment of the invention.
Figure 20B:
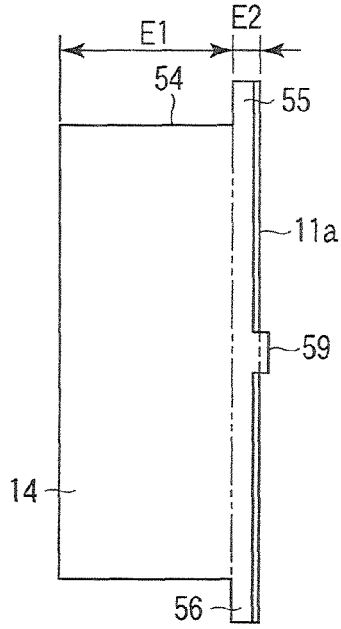
FIG. 20B is a side view of the light source module used in the eighth embodiment of the invention.
Figure 20C:
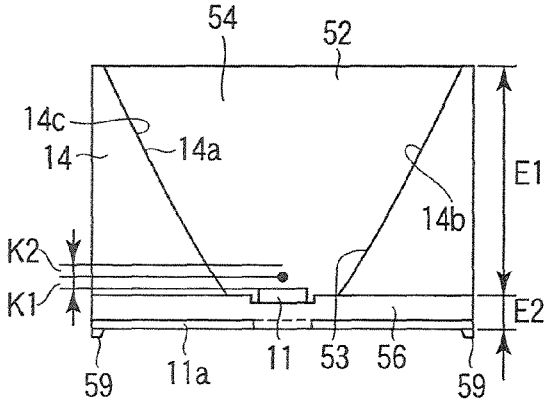
FIG. 20C is a bottom view of the light source module used in the eighth embodiment of the invention.
Figure 20D:
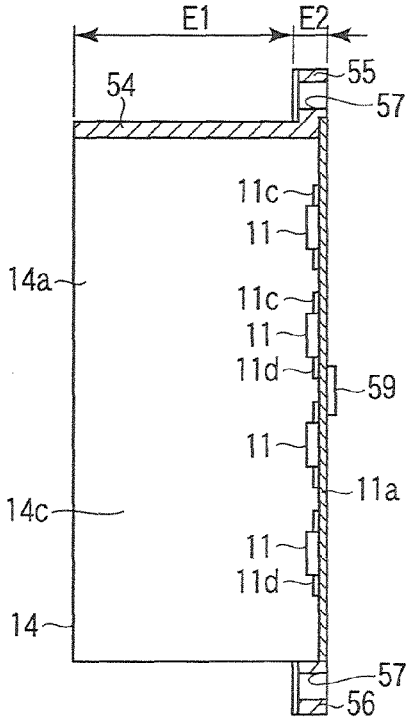
FIG. 20D is a cross section of the light source module used in the eighth embodiment of the invention.

As shown in FIGS. 19A and 20D, each reflector 14 has an integral reflection wall 54. The reflection wall 54 closes the upper end of the reflector 14 so as to face the second irradiation port 53. The reflection wall 54 has an under face continued to the upper end of the light reflection face 14*a*. The under face of the reflection wall 54 is flat and is given a mirror face by vapor-depositing aluminum or silver. The range of vapor deposition of aluminum or silver is limited to the range of the dimension E1.

When the reflector 14 is seen from the front as shown in FIG. 20A, the opening 51 is surrounded from three sides by the two reflection regions 14*b* and 14*c* of the light reflection face 14*a* and the reflection wall 54. In other words, the two reflection regions 14*b* and 14*c* face each other in the width direction of the reflector 14 with the opening 51 therebetween, and the reflection wall 54 is positioned just above the opening 51.

Each reflector 14 has a first fixing part 55 and a second fixing part 56. The first fixing part 55 is integrally projected upward from the upper end of the reflector 14. The second fixing part 56 is integrally projected downward from the lower end of the reflector 14. The first and second fixing parts 55 and 56 are positioned in the range of the width of the reflector 14.

As shown in FIGS. 20A and 20D, each of the first and second fixing parts 55 and 56 has a through hole 57 for passing a fixing part such as a screw. The through hole 57 is positioned in a center portion in each of the first and second fixing parts 55 and 56.

As shown in FIG. 22, an engagement projection 58 is integrally formed in the rear face of each of the first and second fixing parts 55 and 56. The engagement projection 58 is positioned in the center portion of the rear face of each of the first and second fixing parts 55 and 56 in correspondence with the through hole 57. The through hole 57 is formed so as to penetrate the engagement projection 58.

Further, a pair of retaining nails 59 are integrally formed on the rear face of the reflector 14. The retaining nails 59 are positioned between the engagement projections 58 and are projected from the rear face of the reflector 14. Each of the retaining nails 59 has a base continued to the reflector 14 and can be elastically deformed about its base as a fulcrum.

The module substrate 11*a* has an electric insulation plate, a plurality of wiring patterns, and copper foil. The electric insulation plate has a size almost the same as that of the rear face of the reflector 14. The wiring patterns are provided to connect the plurality of LEDs 11 in series and are formed on the surface of the electric insulation plate. The copper foil is an example of a heat spreader and continuously covers the surface and rear face of the electric insulation plate. The copper foil is electrically insulated from the wiring patterns.

Figure 21:
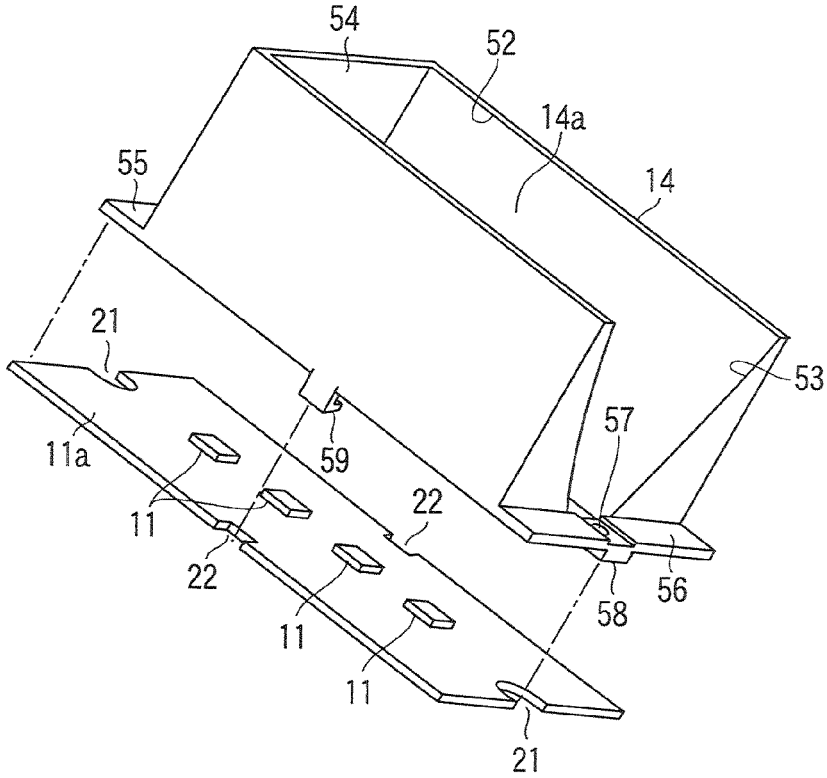
FIG. 21 is a perspective view of the light source module showing a state where a module substrate and a reflector are separated from each other in the eighth embodiment of the invention.

As shown in FIGS. 21 and 22, the module substrate 11*a* has a pair of engagement parts 21 and a pair of nail receiving grooves 22. The engagement parts 21 are positioned at the upper and lower ends in the longitudinal direction of the module substrate 11*a* and each of them has a shape matching the engagement projection 58 of the reflector 14. The engagement part 21 is notched in a U shape so as to be open at the upper or lower edge of the module substrate 11*a*. In the case where the engagement projection 58 in the reflector 14 has a circular column shape, the engagement part 21 of the module substrate 11*a* may be a circular hole.

The nail receiving grooves 22 are notched so as to be open at the right and left side edges of the module substrate 11*a*. The nail receiving groove 22 is positioned in a center portion in the longitudinal direction of the module substrate 11*a*. In the embodiment, the nail receiving grooves 22 are not essential components and need not be provided.

The module substrate 11*a* is held on the rear face of the reflector 14 by making the engagement parts 21 engage with the engagement projections 58 of the reflector 14 and retaining the retaining nails 59 of the reflector 14 by the nail receiving grooves 22. In such a manner, the reflector 14 and the module substrate 11*a* are stacked in a state where they are positioned. As a result, at the time of attaching the light source modules 12 to the first and second attachment parts 17*a* and 17*b* of the frame 17, the reflector 14 and the module substrate 11*a* can be handled as a single assembly. Consequently, the troublesome work of attaching each of the reflector 14 and the module substrate 11*a* individually to the frame 17 is unnecessary.

Further, the nail receiving grooves 22 by which the retaining nails 59 are retained are notched so as to be open at the side edges of the module substrate 11*a*. Consequently, the retaining nails 59 do not protrude in the width direction of the reflector 14, and the narrow reflector 14 can be formed.

As shown in FIGS. 19B and 21, the plurality of LEDs 11 are mounted on the mount surface of the module substrate 11*a* and are electrically connected to wiring patterns. Concretely, as shown in FIGS. 20A and 20D, each LED 11 has an anode 11*c* and a cathode 11*d*. The anode 11*c* and the cathode 11*d* project from the LED 11 in opposite directions and are soldered to the wiring pattern in the module substrate 11*a*. In the embodiment, the LEDs 11 are mounted on the mount surface of the module substrate 11*a* so that the anodes 11*c* and the cathodes 11*d* are arranged in the longitudinal direction of the module substrate 11*a*.

At the time of mounting the LEDs 11 on the module substrate 11*a*, heat dissipating means (not shown) may be provided for the LED 11. In the LED 11, the temperature tends to rise in the anode 11*c* more easily than in the cathode 11*d*. Consequently, by making the anode 11*c* of one of neighboring LEDs 11 on the mount surface of the module substrate 11*a* face the cathode 11*d* of the other LED 11 on the mount surface, the temperature distribution of the module substrate 11*a* can be made uniform. Therefore, variations in the temperature among the plurality of LEDs 11 can be suppressed.

As shown in FIG. 20A, an interval E between neighboring LEDs 11 is preferably 5 mm to 20 mm. By setting the interval F to 5 mm or more, it can be suppressed that light emitted to the arrangement direction of the LEDs 11 from each of the LEDs 11 is interrupted by the other one of the neighboring LEDs 11. Thus, light from the LED 11 can be emitted efficiently. By setting the interval F to 20 mm or less, it can be suppressed that each of the LEDs 11 is recognized as a point light source. In other words, the plurality of LEDs 11 can be seen as continuous with each other, which can make the LEDs 11 look large, and glare can be reduced.

When the module substrate 11*a* is stacked on the reflector 14, the LEDs 11 enter the opening 51 in the reflector 14 and are exposed in the center portion of the light reflection face 14*a*. As a result, the plurality of LEDs 11 arranged linearly are positioned in the center portion in the width direction of the light reflection face 14*a* so that the plurality of LEDs 11 are reflected in the two reflection regions 14*b* and 14*c* in the light reflection face 14*a*.

In other words, the two reflection regions 14*b* and 14*c* in the light reflection face 14*a* are disposed symmetrically with each other using the column of the LEDs 11 as a border. With this arrangement, the distance between each of the LEDs 11 and the reflection region 14*b* and that between each of the LEDs 11 and the other reflection region 14*c* are equal. Therefore, light emitted from the plurality of LEDs 11 arranged linearly is uniformly reflected by the light reflection face 14*a*. Thus, illumination in a predetermined range along the extension direction of the road is made possible while extending light to the entire width of the road.

On the other hand, the reflection wall 54 in the reflector 14 is positioned at the upper end along the arrangement direction of the LEDs 11. Consequently, the distances between the LEDs 11 linearly arranged and the reflection wall 54 are different from each other. The under face of the reflection wall 54 downwardly reflects mainly light emitted from the LED 11 closest to the reflection wall 54.

As shown in FIG. 20C, the light reflection face 14*a* of the reflector 14 has a focus G. The focus G is away from the face positioned in the emission direction of light of the LED 11. Concretely, the face positioned in the emission direction of light of the LED 11 is preferably positioned in a range K1 from the focus G to a position deviated from the focus G by 2 mm toward the module substrate 11*a* or in a range K2 from the focus G to a position deviated from the focus G by 2 mm to the direction opposite to the module substrate 11*a*. In such a manner, light beams from the LED 11 reflected by the light reflection face 14*a* can be prevented from being emitted from the reflector 14 as parallel light beams. Consequently, the light from the LED 11 emitted from the reflector 14 can be widened and the surface of a road or the like can be efficiently illuminated.

The LEDs 11 mounted on the module substrate 11*a* are disposed in the opening 51 in the reflector 14. The peripheries of the opening 51 face each other with the LEDs 11 therebetween. For this reason, when the light source module 12 is seen from the front, as shown in FIG. 20A, the anodes 11*c* and the cathodes 11*d* of the LEDs 11 are not covered with the reflector 14 but are exposed on the inside of the reflector 14.

The LED 11 generates heat when it is on. The heat of the LED 11 is transmitted to the anode 11*c* and the cathode 11*d* close to the LED 11 and solder connecting the electrodes and the wiring patterns. The anode 11*c* and the cathode 11*d* of each LED 11 are exposed on the inside of the reflector 14. Consequently, the heat of the LED 11 transmitted to the anode 11*c*, the cathode 11*d*, and the solder can be dissipated to the atmosphere without being disturbed by the reflector 14. By such heat dissipation, a temperature rise of the LED 11 is suppressed, and deterioration in the luminous efficacy and the life of the LED 11 can be suppressed.

Moreover, the LEDs 11 are arranged linearly on the inside of the opening 51, so that a slit-shaped gap is formed between each LED 11 and the periphery of the opening 51. Due to the current of air passing through the gap, heat retention around the LEDs 11 is suppressed, and heat dissipation of the LEDs 11 is accelerated. As a result, occurrence of a temperature difference among the plurality of LEDs 11 is prevented, and variations in emission colors of the LEDs 11 can be suppressed.

In the eighth embodiment, to accelerate heat dissipation of the LEDs 11, the anodes 11*c*, the cathodes 11*d*, and the soldered parts between the electrodes and the wiring patterns are exposed on the inside of the reflector 14.

However, the present invention is not limited to the above configuration. For example, the anode 11*c* or the cathode 11*d* may be covered with the reflector 14. Further, the soldered part between the anode 11*c* and the wiring pattern or the soldered part between the cathode 11*d* and the wiring pattern may be covered with the reflector 14. In such a case as well, the heat dissipation performance of the LED 11 is increased, and deterioration in the luminous efficacy of the LED 11 can be suppressed.

In short, by making at least one of the anode 11*c* and the cathode 11*d* exposed on the inside of the reflector 14, the heat of the LED 11 can be dissipated via the module substrate 11*a*. Therefore, deterioration in the luminous efficacy of the LED 11 can be suppressed, and a high-performance street light 10 can be obtained.

The light source modules 12 are fixed on the attachment faces 17*e* of the first and second attachment parts 17*a* and 17*b* of the frame 17 in the longitudinal direction of the first and second attachment parts 17*a* and 17*b*. Each of the light source modules 12 is fixed by making screws 25 (shown in FIG. 15) pass through the through holes 57 in the first and second fixing parts 55 and 56 of the reflector 14 and screwing the screws 25 in the first and second attachment parts 17*a* and 17*b*. By fastening the screws 25, the module substrate 11*a* is sandwiched between the frame 17 and the reflector 14. The rear face of the reflector 14 is thermally connected to the first and second attachment parts 17*a* and 17*b* of the frame 17 via the module substrate 11*a*.

Therefore, most of heat generated by the LEDs 11 at the time of light-on of the street light 10 is transmitted to the frame 17 via the module substrate 11*a* and is also transmitted from the frame 17 to the apparatus body 15. The heat of the LEDs 11 transmitted to the apparatus body 15 is released from the surface of the apparatus body 15 to the atmosphere.

The module substrate 11*a* has copper foil as a heat spreader. Consequently, the heat of the LEDs 11 transmitted to the module substrate 11*a* can be efficiently transmitted to the frame 17 by using the copper foil. The copper foil on the module substrate 11*a* and aluminum or silver vapor-deposited on the reflector 14 are discontinuous.

Figure 16:
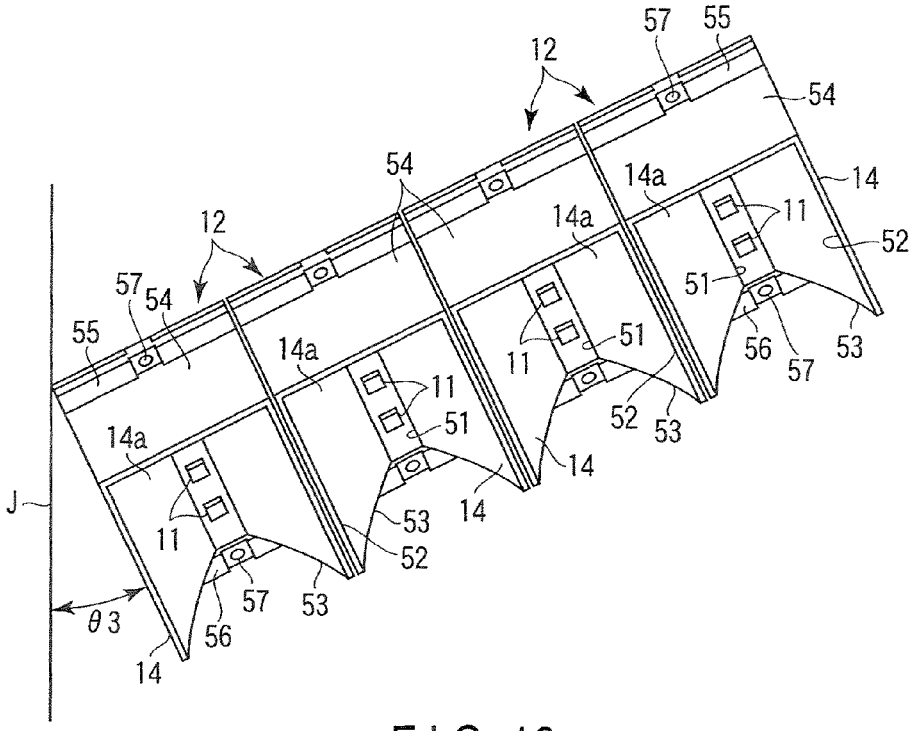
FIG. 16 is a side view showing an arrangement state of a plurality of light source modules in the eighth embodiment of the invention.
Figure 17:
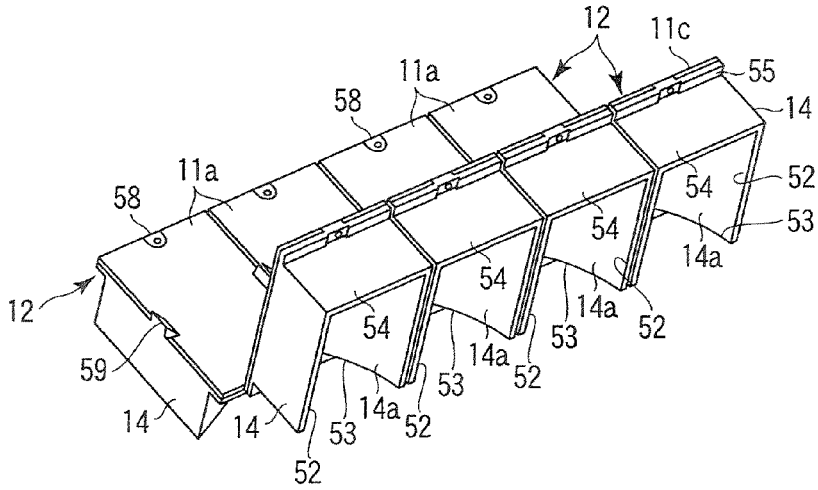
FIG. 17 is a perspective view showing the arrangement state of the plurality of light source modules in the eighth embodiment of the invention.
Figure 18:
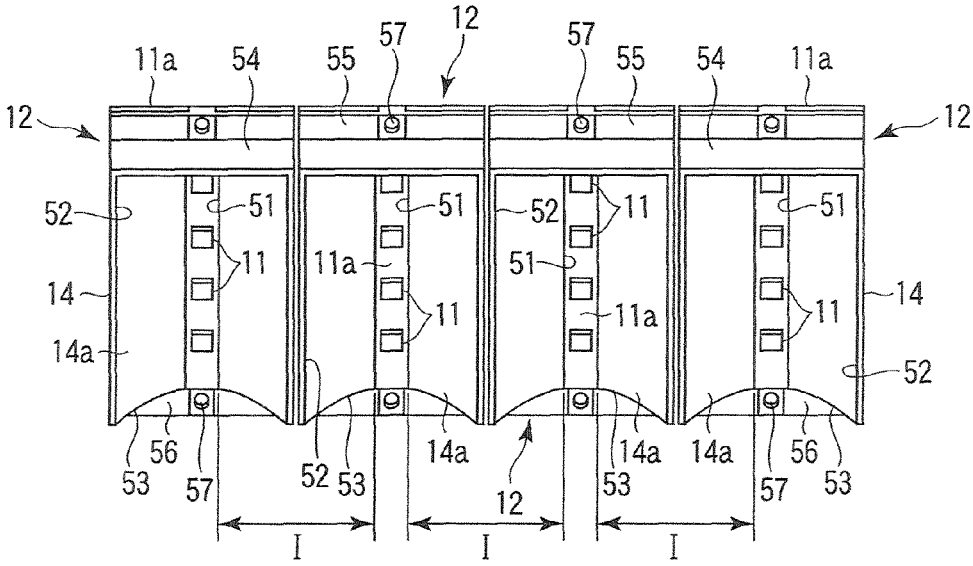
FIG. 18 is a side view showing the arrangement state of the plurality of light source modules in the eighth embodiment of the invention.

FIGS. 16 to 18 disclose a state where the plurality of light source modules 12 are arranged linearly. The arrangement direction of the plurality of LEDs 11 of the light source modules 12 is orthogonal to the arrangement direction of the light source modules 12. For example, in FIG. 18, the plurality of light source modules 12 are arranged in the lateral direction. On the other hand, the LEDs 11 of each of the light source modules 12 are arranged in the vertical direction.

As shown in FIG. 18, each of the light source modules 12 has a column of the LEDs 11 arranged linearly. The columns of the LEDs 11 of neighboring light source modules 12 are arranged at an interval I. The interval I is 30 mm to 70 mm. By setting the interval I to such a value, the columns of the LEDs 11 in the plurality of light source modules 12 are not seen independently of each other. Consequently, an appearance such that the plurality of light source modules 12 look like a single light source continuous in the longitudinal direction of the apparatus body 15 can be obtained. Such an advantage in appearance of the light source modules 12 is realized by making the first and second fixing parts 55 and 56 of the reflector 14 of each of the light source modules 12 lie in the range of the width of the reflector 14.

That is, the first and second fixing parts 55 and 56 do not protrude in the width direction of the reflector 14, so that occurrence of a useless gap between neighboring reflectors 14 can be prevented as much as possible. As a result, the interval between neighboring light source modules 12 can be minimized and the interval I of the columns of the LEDs 11 can be set to the above-described value.

Figure 12:
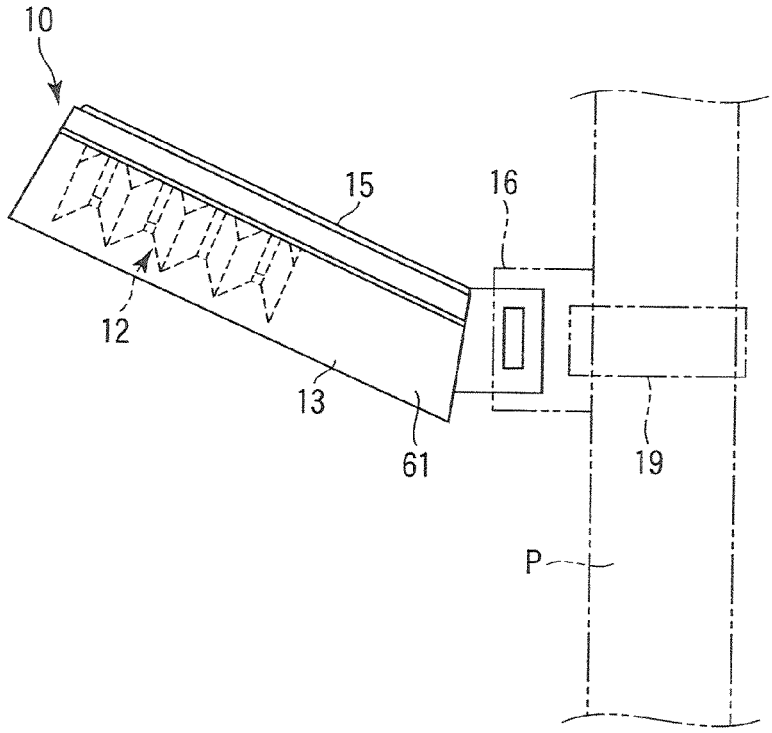
FIG. 12 is a side view of a street light as an eighth embodiment of the invention.

As shown in FIG. 12, the apparatus body 15 of the street light 10 is fixed to an upper part in the poles P mounted at predetermined intervals on the side of a road by using the support member 16 and the attachment band 19. The apparatus body 15 is fixed to the pole P in an attitude in which it tilts upward toward a center portion in the width direction of the road with respect to the vertical line J (shown in FIG. 16) parallel to the pole P. A tilt angle θ3 of the apparatus body 15 is 10° to 40°. By setting the tilt angle θ3 of the apparatus body 15 to 10° to 40°, light is emitted to the center portion along the width direction of the road, and illuminance of the road surface as a face to be illuminated can be increased.

Simultaneously, as shown in FIG. 16, when the light source modules 12 are seen from a side, the column of LEDs 11 of each of the light source modules 12 is disposed tilted so that the upper the LED 11 in the column, the closer to the vertical line J. Similarly, the light reflection faces 14*a* of the reflectors 14 are disposed tilted so that the upper the light reflection face 14*a*, the closer to the vertical line J.

The translucent cover 13 is supported by the apparatus body 15 and covers the light source modules 12, the frame 17, and the lighting device 20 from below. The translucent cover 13 is made of a synthetic resin material such as a transparent acrylic resin. The surface of the translucent cover 13 is subjected to a frosting process so that the interior of the street light 10 cannot be seen.

Figure 13:
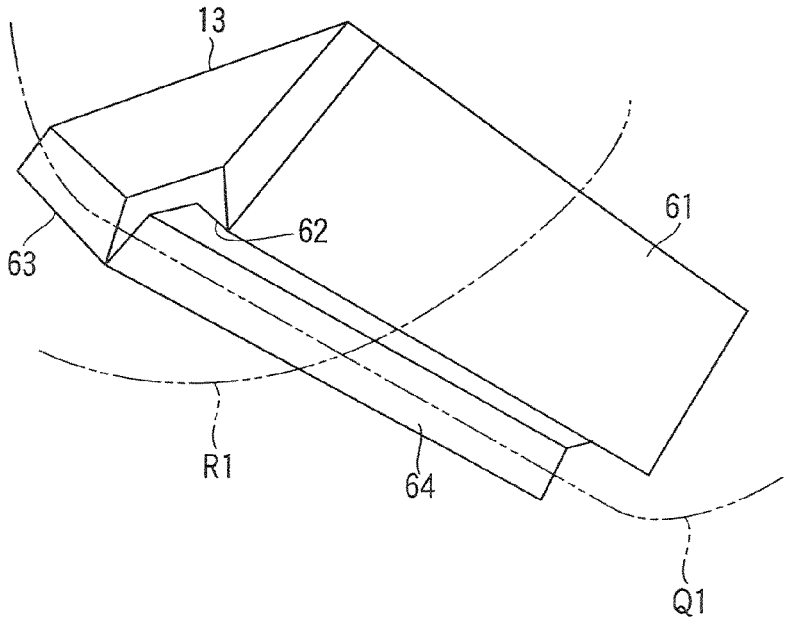
FIG. 13 is a perspective view of the street light as the eighth embodiment of the invention.
Figure 14:
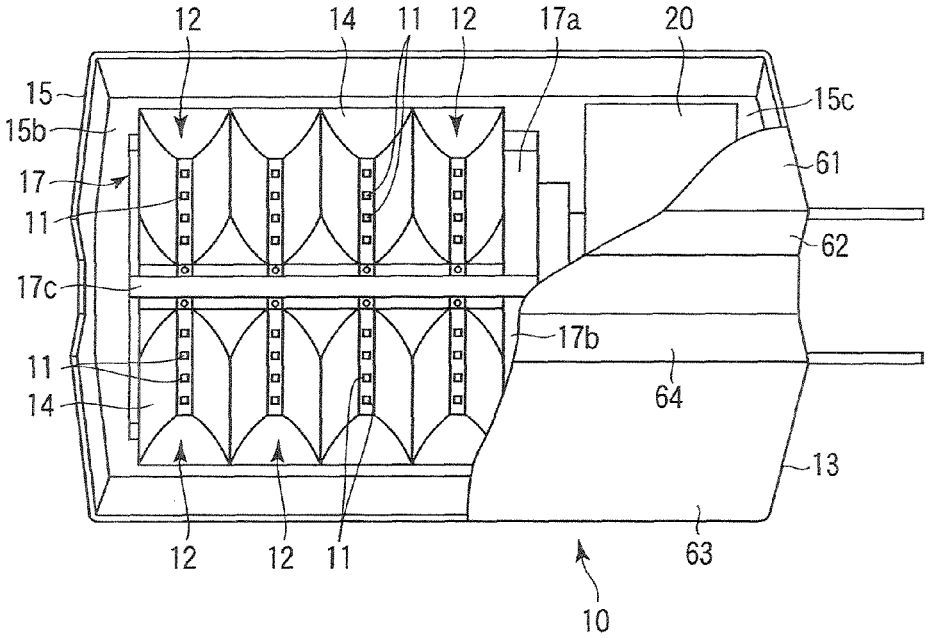
FIG. 14 is a partly-cutaway front view of the street light as the eighth embodiment of the invention.

As shown in FIGS. 13 to 15, the translucent cover 13 has first to fourth light transmission parts 61, 62, 63, and 64. The first light transmission part 61 is provided almost parallel with the first attachment part 17*a* of the frame 17. The first light transmission part 61 covers the first irradiation ports 52 of the plurality of light source modules 12 fixed to the first attachment part 17*a* from below and is disposed so as to be orthogonal to the emission direction of light reflected by the light reflection face 14*a*. The second light transmission part 62 extends obliquely upward from the lower end of the first light transmission part 61 so as to be almost orthogonal to the first light transmission part 61. The second light transmission part 62 is continued to the first light transmission part 61. Further, the second light transmission part 62 covers the second irradiation ports 53 of the plurality of light source modules 12 fixed to the first attachment part 17*a* from below and is disposed so as to be orthogonal to the emission direction of light reflected by the under face of the reflection wall 54.

The third light transmission part 63 is provided almost parallel with the second attachment part 17*b* of the frame 17. The third light transmission part 63 covers the first irradiation ports 52 of the plurality of light source modules 12 fixed to the second attachment part 17*b* from below and is disposed so as to be orthogonal to the emission direction of light reflected by the light reflection face 14*a*. The fourth light transmission part 64 extends obliquely upward from the lower end of the third light transmission part 63 so as to be almost orthogonal to the third light transmission part 63. The fourth light transmission part 64 is continued to the third light transmission part 63. Further, the fourth light transmission part 64 covers the second irradiation ports 53 of the plurality of light source modules 12 fixed to the second attachment part 17*b* from below and is disposed so as to be orthogonal to the emission direction of light reflected by the under face of the reflection wall 54.

By employing such a translucent cover 13', there are advantages as follows. Specifically, light of LED 11 reflected by the light reflection face 14*a* of the light source module 12 and traveling to the first irradiation port 52 and light emitted from the LED 11 directly to the first irradiation port 52 passes through the first and third light transmission parts 61 and 63 in the translucent cover 13 as shown by arrows N in FIG. 15. The first and third light transmission parts 61 and 63 are disposed so as to be orthogonal to the irradiation direction of light indicated by the arrows N. Consequently, the light incident on the first and third light transmission parts 61 and 63 is hardly reflected by the first and third light transmission parts 61 and 63 and passes through the first and third light transmission parts 61 and 63.

Similarly, the light of the LED 11 reflected by the under face of the reflection wall 54 of the light source module 12 and traveling to the second irradiation port 53 and light emitted from the LED 11 directly to the second irradiation port 53 passes through the second and fourth light transmission parts 62 and 64 in the translucent cover 13 as shown by arrows M in FIG. 15. The second and fourth light transmission parts 62 and 64 are disposed so as to be orthogonal to the irradiation direction of light indicated by the arrows M. Consequently, the light incident on the second and fourth light transmission parts 62 and 64 is hardly reflected by the second and fourth light transmission parts 62 and 64 and passes through the second and fourth light transmission parts 62 and 64.

Therefore, loss of light when the light of the LED 11 passes through the translucent cover 13 is reduced, and the light can be efficiently emitted outside of the translucent cover 13.

Further, four faces of the first to fourth light transmission parts 61 to 64 of the translucent cover 13 shine due to the light emitted from the LEDs 11. Consequently, sufficient light can be led to places needing illumination and the appearance of the street light 10 which is turned on becomes characteristic.

In the street light 10 of the eighth embodiment of the invention, the plurality of light source modules 12 are arranged in the longitudinal direction of the apparatus body 15. The plurality of LEDs 11 of each of the light source modules 12 are arranged linearly along the longitudinal direction of the reflectors 14. Therefore, arrangement of the parts in the apparatus body 15 can be simplified and the arrangement of the LEDs 11 can be also simplified.

Further, each of the light source modules 12 arranged in the longitudinal direction of the apparatus body 15 has the reflector 14, and distribution of light emitted from the LEDs 11 is controlled by the light reflection face 14*a* of the reflector 14. As a result, illumination over a wide range is enabled, and appropriate brightness required by the street light 10 can be obtained.

The LEDs 11 assembled to the reflector 14 are disposed in the center portion in the width direction of the light reflection face 14*a* on the inside of the light reflection face 14*a* curved in a circular arc shape. With this arrangement, the column of the LEDs 11 arranged linearly is reflected in each of the two reflection regions 14*b* and 14*c* in the light reflection face 14*a*. Each of the images of the LEDs 11 reflected in the reflection regions 14*b* and 14*c* is expanded and larger than the actual size of the LED 11. That is, the existence of the light reflection face 14*a* makes it appear as if there are more LEDs 11 than there actually are, and makes each of the LEDs 11 look larger. Therefore, although each of the LEDs 11 is a point light source of high brightness, glare can be reduced.

In the light source module 12 of the embodiment, the distances from the LEDs 11 arranged linearly to the reflection regions 14*b* and 14*c* in the light reflection face 14*a* are maintained uniformly. Consequently, reflection of the light reflection face 14*a* with respect to each of the LEDs 11 is controlled equally. Therefore, while light to be emitted in the direction of the arrow N in FIG. 15 is widened in the width direction of the road by the light reflection face 14*a*, the light is led to a far place along the longitudinal direction of the road. Thus, a road can be illuminated over a wide range.

In a street light, the distribution of light emitted from a light source can be controlled by using a lens. In the case of using a lens, however, it is disadvantageous with respect to the point that brightness of the light source is increased, and a person perceives the glare more acutely. In the case where a number of LEDs are arranged to increase the quantity of light, a lens for controlling light of the LEDs becomes inevitably large, and it is disadvantageous from the viewpoint of cost.

Further, in the case of controlling light distribution by a combination of a plurality of small lenses and a plurality of LEDs, troublesomeness at the time of assembling a street light is increased. Due to light passing through the plurality of lenses, the LEDs look independent of each other, and the presence of the LEDs of high brightness increases. Therefore, it is disadvantageous that a person perceives the glare more acutely.

In contrast, in the street light 10 of the eighth embodiment of the present invention, a luminous intensity distribution is controlled by the light source module 12 in which each of the LEDs 11 appear large by using the reflection of light, so that an inconvenience as described above does not occur.

Further, in the eighth embodiment, the reflector 14 assembled with the LED 11 has the reflection wall 54 that closes the upper end of the light reflection face 14*a*. The under face of the reflection wall 54 is finished as a mirror face by which mainly upward light emitted from the LED in the highest position is reflected downward to the second irradiation port 53. Therefore, leakage of the light of the LED 11 above the street light 10 can be prevented, and the influence on the living space in a neighborhood and the natural environment can be reduced.

In addition, as shown by the arrows M in FIG. 15, light reflected by the under face of the reflection wall 54 passes through the second irradiation port 53 and the second and fourth light transmission parts 62 and 64 in the translucent cover 13 and is emitted to the region just below the street light 10. Consequently, brightness just below the street light 10 can be sufficiently assured.

Figure 23:
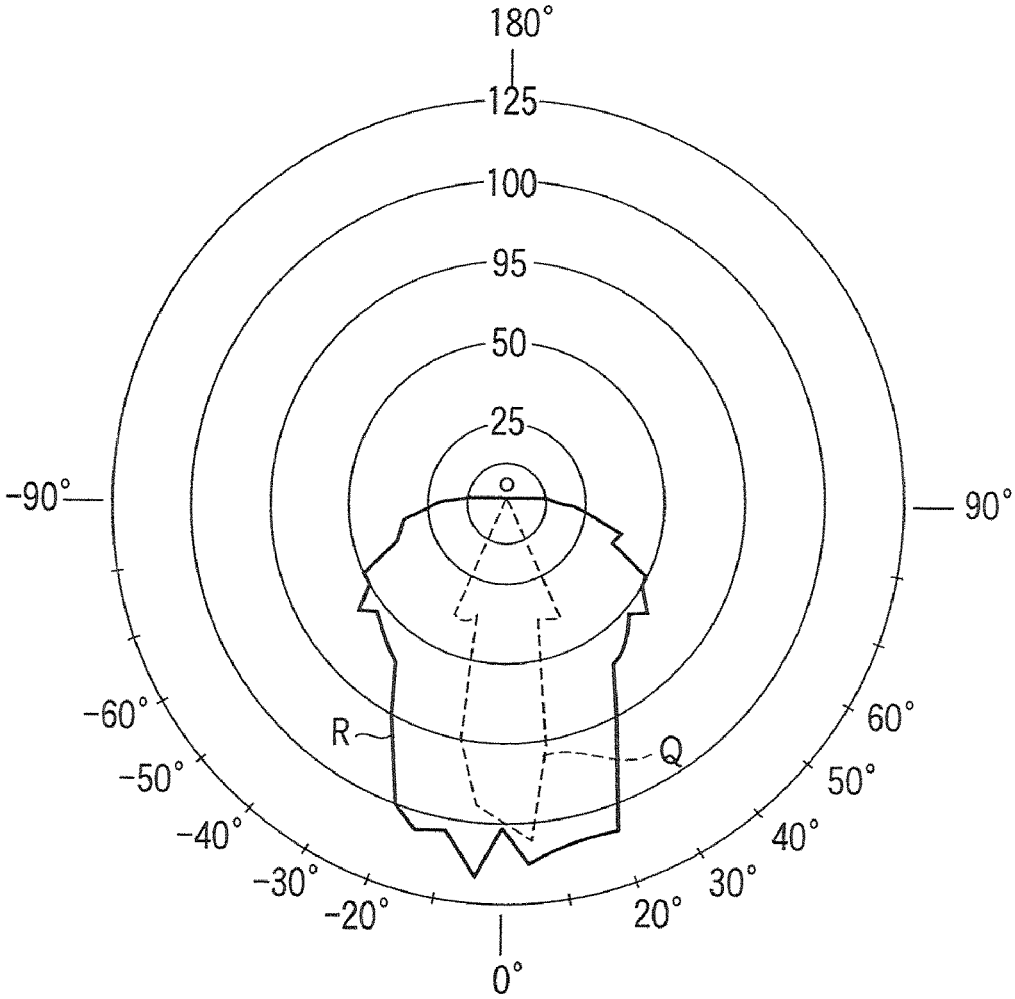
FIG. 23 is a diagram showing a light intensity distribution of the street light in the eighth embodiment of the invention.

FIG. 23 shows a light intensity distribution of the street light 10 as the eighth embodiment. In FIG. 23, a broken line Q shows the light intensity distribution along the longitudinal direction of the apparatus body 15 (the arrangement direction of the plurality of light source modules 12) when the vertical line passing through the ridge 17*c* of the frame 17 of the light source module 12 is used as a reference. That is, the light intensity distribution Q shows a luminous intensity distribution state when luminous intensity is measured along the longitudinal direction of the street light 10 shown by the dashed line Q1 in FIG. 13. In FIG. 23, 0° shows a position just below the street light 10. Further, in FIG. 23, the luminous intensity just below the street light 10 is indicated as a reference value 100.

According to the light intensity distribution Q shown in FIG. 23, total flux lies in a range of 0° to ±50° from the vertical line passing through the ridge 17*c*. Further, the luminous flux distribution rate at 0° to less than ±20° from the vertical line is 50% to 60%, and the luminous flux distribution rate in the range of ±20° to is ±50° from the vertical line is 40% to 50%.

With the light intensity distribution Q, a spot light of high luminous intensity can be emitted to a region just below the street light 10 as a face to be illuminated closest to the street light 10. Therefore, horizontal illuminance just below the street light 10 can be increased efficiently, and the region just below the street light 10 can be illuminated lightly. As a result, glare of the street light 10 is reduced, and the value of GR (Glare Rating) in the application as the street light 10 can be reduced.

On the other hand, in FIG. 23, a solid line R indicates the light intensity distribution along the direction orthogonal to the longitudinal direction of the apparatus body 15 (the arrangement direction of the plurality of light source modules 12) when the vertical line passing through the ridge 17*c* of the frame 17 of the light source module 12 is used as a reference. That is, the light intensity distribution R shows a luminous intensity distribution state when luminous intensity is measured along the width direction of the street light 10 shown by the dashed line R1 in FIG. 13. According to the light intensity distribution R of the eighth embodiment, the luminous flux distribution rate at 0° to less than ±20° from the vertical line is 10% to 20%, the luminous flux distribution rate at ±20° to less than ±50° from the vertical line is 35% to 45%, the light luminous distribution rate at ±50° to less than 90° from the vertical line is 35% to 45%, and the luminous flux distribution rate at ±90° to ±180° from the vertical line is less than 5%.

With the light intensity distribution R, light emitted downward from the street light 10 is distributed so as to expand symmetrically with respect to the vertical line as a center. Consequently, for example, a linear road can be illuminated over a wide range in the extension direction of the road, and the horizontal illuminance can be increased by distribution of light traveling to the region just below the street light 10.

As a result, interdependently with the existence of the light intensity distribution Q, the region just below the street light 10 can be illuminated with sufficient brightness, and glare of the street light 10 is reduced. Therefore, for example, the value of GR in the application as the street light 10 can be set to 50 or less.

Moreover, as is obvious from the light intensity distribution Q shown in FIG. 23, the distribution of light emitted to the upper side of the street light 10 is less than 5%, so that leakage of light above the street light 10 is suppressed. Therefore, an adverse influence on the living space in a neighborhood and the natural environment can be suppressed.

Figure 24:
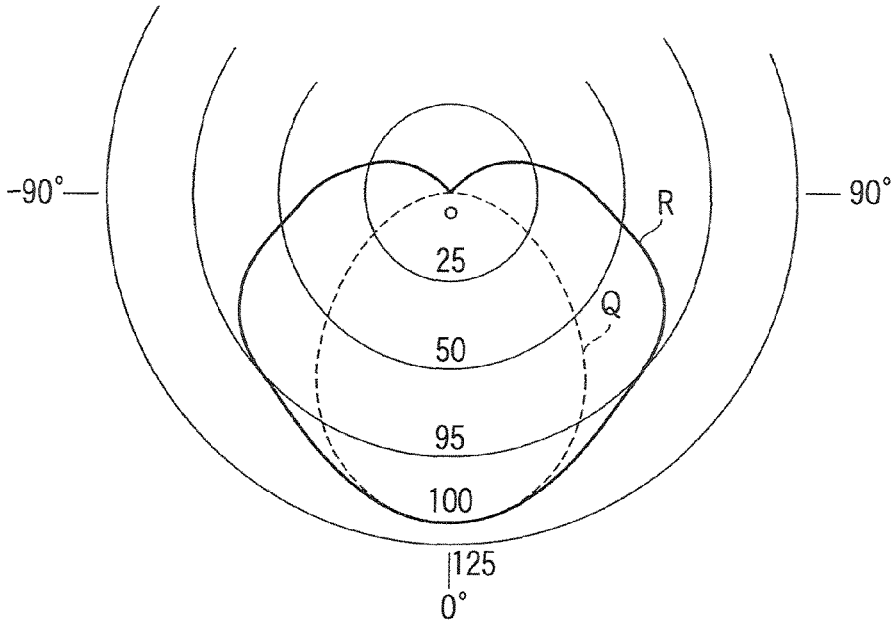
FIG. 24 is a diagram showing a light intensity distribution of a conventional street light using a fluorescent lamp as a light source.
Figure 25:
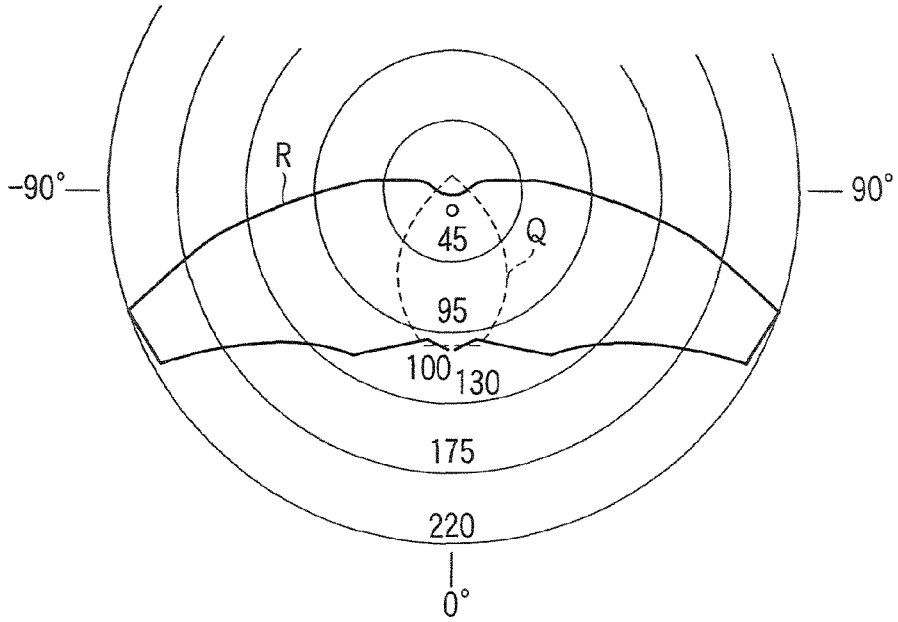
FIG. 25 is a diagram showing a light intensity distribution of a conventional street light using a mercury lamp as a light source.

FIGS. 24 and 25 show light intensity distributions of known street lights. In FIGS. 24 and 25, in a manner similar to the eighth embodiment of the present invention shown in FIG. 23, the light intensity distribution Q is shown by a dotted line, the light intensity distribution R is indicated by a solid line, and the luminous intensity 100 just below the street light is used as a reference value.

FIG. 24 shows the light intensity distribution of the street light using a fluorescent lamp as the light source. FIG. 25 shows the light intensity distribution of the street light using a mercury lamp as the light source. The light intensity distributions of the conventional street lights are quite different from the light intensity distribution of the street light 10 as the eighth embodiment of the present invention. Specifically, in conventional street lights, highest luminance is inadequate. Moreover, in the street light of FIG. 24 using the fluorescent lamp as the light source, light does not easily reach a far place in the longitudinal direction of a road, and it is difficult to illuminate a road over a wide range. In the street light of FIG. 25 using the mercury lamp as the light source, it is difficult to obtain sufficient brightness just below the street light.

The illumination apparatus of the present invention is not limited to a street light assumed to be used outdoors. For example, the present invention can be also similarly applied to an illumination apparatus for indoors for illuminating a corridor of a research facility, a library, a museum, or the like over a wide range. In an illumination apparatus assumed to be used indoors, a packing for waterproofing interposed between the apparatus body and the translucent cover need not be provided.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A light source module comprising:

a module substrate;

a plurality of light emitting elements arranged linearly and mounted on the module substrate; and a reflector including an opening extending in an arrangement direction of the light emitting elements and having a pair of peripheries facing each other with the light emitting elements therebetween, a first irradiation port facing the opening, a light reflection face extending from the peripheries of the opening so as to gradually expand toward the first irradiation port, a reflection wall disposed at one end along the arrangement direction of the light emitting elements so as to cross the light reflection face, and a second irradiation port facing the reflection wall at the other end along the arrangement direction of the light emitting elements.

2. The light source module according to claim 1, wherein the reflector is fixed on the module substrate, and the light emitting elements are exposed on the light reflection face via the opening in the reflector.

3. The light source module according to claim 1, wherein the light reflection face has two reflection regions disposed symmetrically with the light emitting elements arranged linearly therebetween, the reflection regions are curved so that the light emitting elements reflected in the light reflection face appear larger, and the reflection wall has a flat face continued to the reflection regions.

4. The light source module according to claim 3, wherein the light reflection face has a focal point, and each of the light emitting elements is away from the focal point.

5. An illumination apparatus comprising:

an apparatus body;

a frame supported by the apparatus body, the frame including first and second attachment parts, the first and second attachment parts facing each other so as to tilt in opposite directions; and a plurality of light source modules provided on the first and second attachment parts, each of the light source modules including:

a reflector supported on each of the first and second attachment parts, the reflector comprising a light reflection face curved in an arc shape; and a plurality of light emitting elements arranged on the light reflection face of the reflector;

wherein the reflector of each of the light source modules has a plurality of fixing parts overlapping the first and second attachment parts of the frame, the fixing parts are projected from the reflector along a direction orthogonal to the arrangement direction of the light source modules, the reflector has a width in the arrangement direction of the light source modules, and the fixing parts are positioned in a range of the width of the reflector.

6. The illumination apparatus according to claim 5, further comprising a module substrate on which the light emitting elements are mounted;

wherein the module substrate of the light source module has an outer periphery sandwiched between the frame and the reflector and a plurality of engagement parts formed in the outer periphery, and the reflector has a plurality of projections which engage with the engagement parts, thereby determining relative positions between the reflector and the module substrate, and a plurality of retaining nails which retain the outer periphery of the module substrate, thereby holding the module substrate in the reflector.

7. The illumination apparatus according to claim 6, wherein the frame and the reflector are made of a metal, and the light emitting elements are thermally connected to the frame and the reflector via the module substrate.

8. An illumination apparatus comprising:

an apparatus body;

a frame supported by the apparatus body, the frame including first and second attachment parts, the first and second attachment parts facing each other so as to tilt in opposite directions; and a plurality of light source modules provided on the first and second attachment parts, each of the light source modules including:

a reflector supported on each of the first and second attachment parts, the reflector comprising a light reflection face curved in an arc shape; and a plurality of light emitting elements arranged on the light reflection face of the reflector;

wherein the first and second attachment parts are disposed in a V shape at a predetermined angle;

wherein the light emitting elements are arranged linearly in a direction crossing an arrangement direction of the light source modules; and wherein the reflector includes an opening extending in an arrangement direction of the light emitting elements and positioned in a center portion of the light reflection face, a first irradiation port facing the opening, a reflection wall disposed at one end along the arrangement direction of the light emitting elements so as to cross the light reflection face, and a second irradiation port facing the reflection wall at the other end along the arrangement direction of the light emitting elements.

9. The illumination apparatus according to claim 8, wherein the light reflection face has two reflection regions disposed symmetrically with the light emitting elements arranged linearly therebetween, the reflection regions are curved so that the light emitting elements reflected in the light reflection face appear larger, and the reflection wall has a flat face continued to the reflection region.

10. The illumination apparatus according to claim 9, further comprising a translucent cover supported by the apparatus body so as to cover the frame and the light source modules, the translucent cover including: a first light transmission part which covers the first irradiation port of the light source module arranged in the first attachment part, a second light transmission part which covers the second irradiation port of the light source module arranged in the first attachment part, a third light transmission part which covers the first irradiation port of the light source module arranged in the second attachment part, and a fourth light transmission part which covers the second irradiation port of the light source module arranged in the second attachment part.

11. The illumination apparatus according to claim 10, wherein the first and third light transmission parts are disposed so as to be almost orthogonal to an emission direction of light emitted from the first irradiation port, and the second and fourth light transmission parts are disposed so as to be almost orthogonal to an emission direction of light emitted from the second irradiation port.

12. The illumination apparatus according to claim 11, wherein a light intensity distribution along the arrangement direction of the light source modules when a vertical line is a reference is such that the total flux lies in a range of 0° to ±50° from the vertical line, the luminous flux distribution rate in 0° to less than ±20° from the vertical line is 50% to 60%, and the luminous flux distribution rate in the range of ±20° to ±50° from the vertical line is 40% to 50%.

13. The illumination apparatus according to claim 12, wherein a light intensity distribution along a direction orthogonal to an arrangement direction of the light source modules when a vertical line is a reference is such that the luminous flux distribution rate at 0° to less than ±20° from the vertical line is 10% to 20%, the luminous flux distribution rate at ±20° to less than ±50° from the vertical line is 35% to 45%, the luminous flux distribution rate at ±50° to less than ±90° from the vertical line is 35% to 45%, and the luminous flux distribution rate at ±90° to less than ±180° from the vertical line is less than 5%.

14. The illumination apparatus according to claim 11, wherein the first and second light transmission parts are continued to each other, and the third and fourth light transmission parts are continued to each other.

15. The illumination apparatus according to claim 8, wherein the opening has a pair of peripheries facing each other with the light emitting elements therebetween, and the light reflection face is extended from the peripheries of the opening so as to gradually expand toward the first irradiation port.

16. The illumination apparatus according to claim 8, further comprising a module substrate on which the light emitting elements are mounted;

wherein the module substrate of the light source module has an outer periphery sandwiched between the frame and the reflector and a plurality of engagement parts formed in the outer periphery, and the reflector has a plurality of projections which engage with the engagement parts, thereby determining relative positions between the reflector and the module substrate, and a plurality of retaining nails which retain the outer periphery of the module substrate, thereby holding the module substrate in the reflector.

17. The illumination apparatus according to claim 16, wherein the frame and the reflector are made of a metal, and the light emitting elements are thermally connected to the frame and the reflector via the module substrate.

* * * * *

UNITED STATES PATENT AND TRADEMARK OFFICE

CERTIFICATE OF CORRECTION

PATENT NO. : 8,235,546 B2
APPLICATION NO. : 12/473482
DATED : August 7, 2012
INVENTOR(S) : Masako Takasago et al.

It is certified that error appears in the above-identified patent and that said Letters Patent is hereby corrected as shown below:

TITLE PAGE,
Item [73], Assignee, after "Toshiba Lighting & Technology Corporation, Tokyo, Japan (JP)" insert, on a new line, --Kabushiki Kaisha Toshiba, Tokyo, Japan (JP)--

Signed and Sealed this
Fourteenth Day of May, 2013

Teresa Stanek Rea
*Acting Director of the United States Patent and Trademark Office*